United States Patent [19]

Takatori

[11] 4,188,897

[45] Feb. 19, 1980

[54] SEAMING METHOD FOR GORED PANTY-HOSE

[75] Inventor: Osho Takatori, Nara, Japan

[73] Assignee: Takatori Machinery Works, Ltd., Yamatotakada, Japan

[21] Appl. No.: 887,133

[22] Filed: Mar. 16, 1978

[30] Foreign Application Priority Data

Mar. 25, 1977 [JP] Japan ..... 52-33797
Mar. 11, 1978 [JP] Japan ..... 53-28078

[51] Int. Cl.[2] ..... D05B 21/00
[52] U.S. Cl. ..... 112/262.2; 112/121.15
[58] Field of Search ..... 112/121.15, 121.11, 112/121.12, 262; 2/409; 223/112, 43

[56] References Cited

U.S. PATENT DOCUMENTS

| | | | |
|---|---|---|---|
| 2,702,014 | 2/1955 | Brownstein | 112/121.15 |
| 3,669,047 | 6/1972 | Hedegaard | 2/409 X |
| 3,675,247 | 7/1972 | Ferrell | 2/409 |
| 3,777,681 | 12/1973 | Horita | 112/121.15 |

*Primary Examiner*—H. Hampton Hunter
*Attorney, Agent, or Firm*—Kenyon & Kenyon

[57] ABSTRACT

Disclosed is a method and apparatus for seaming panty-hose having gores at the crotch portions thereof. A pair of overlapping stocking materials mounted on a template unit are partially sliced along a predetermined line and are spread out to a reverse V-shape so that the sliced edge portions of the stocking materials are exposed outward. Then, a diamond shaped gore material which is folded in two is inserted between the overlapping portions of the stocking materials. Sliced portions of the stocking materials are substantially positioned along a straight line and a sliced edge portion of one stocking material and an edge portion of the gore material, which edge portions are overlapped, are seamed together by means of a first sewing machine. Then, another sliced edge portion of the other stocking material and another edge portion of the gore material which are also overlapped are also seamed together by means of a second sewing machine.

11 Claims, 65 Drawing Figures

PRIOR ART
Fig. 1a
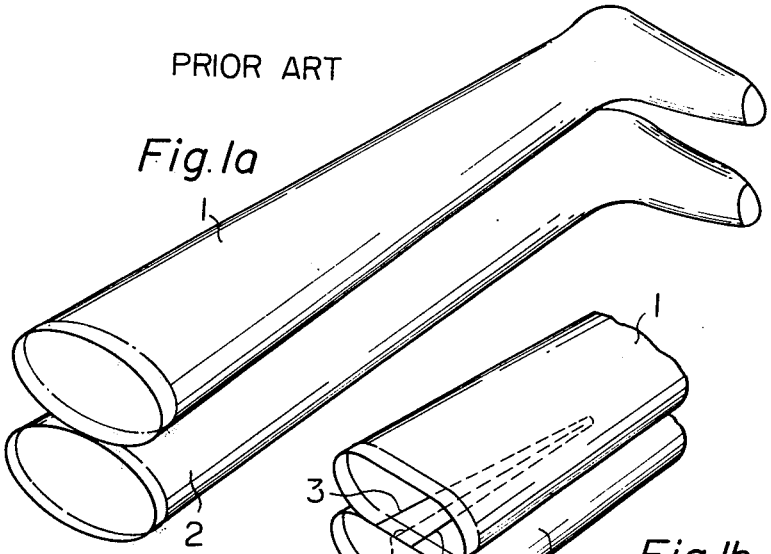
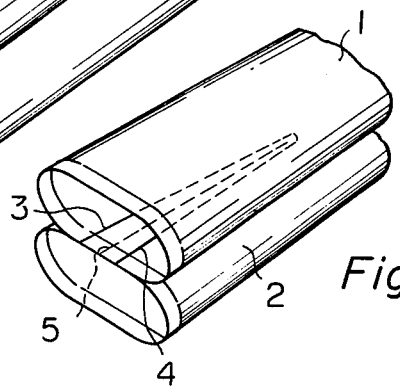
Fig. 1b
Fig. 1c
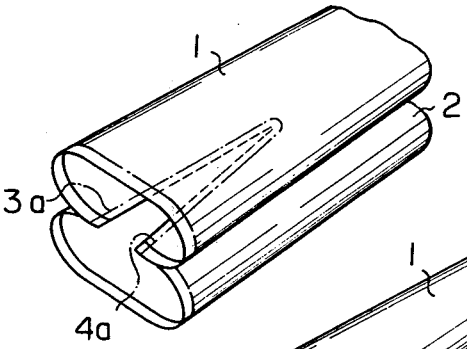
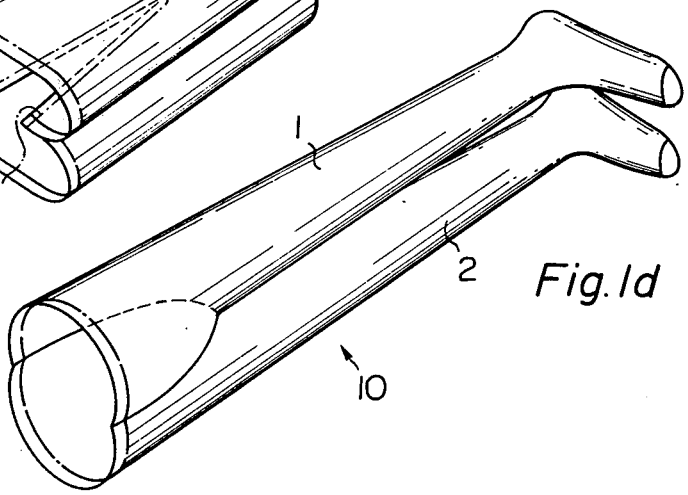
Fig. 1d

Fig. 26(E 1)

SEAMING METHOD FOR GORED PANTY-HOSE

BRIEF DESCRIPTION OF THE INVENTION

The present invention relates to a seaming method for manufacturing gored panty-hose, especially panty-hose having gores of a diamond shape at the crotch portions thereof and also relates to an apparatus for effecting the method.

BACKGROUND OF THE INVENTION

Panty-hose, which are constituted by a pair of stockings and a panty in one body, are being widely worn at present, since they fit on a variety of human body figures. Conventionally panty-hose are automatically seamed by utilizing a seaming machine, in which a pair of stocking materials are sewn and combined into goreless panty-hose on a circulating template unit which has a pair of template assemblies for upholding and spreading the stocking materials mounted thereon. The seaming machine also includes a cutter assembly for partly slicing the stocking materials upheld by the template assemblies and a sewing machine for seaming the spread stocking materials together. (U.S. Pat. No. 3,777,681). The above-mentioned seaming machine was developed based on the fact that the panty-hose can fit a variety of human body figures even without the presence of the gore if the inherent stretchability of the knitted fabric material is effectively utilized.

However, recently some wearers desire panty-hose which can fit better than the above-mentioned goreless panty-hose. The panty portion of goreless panty-hose is stretched in accordance with a variety of human body figures, especially the material positioned at a thigh portion thereof which connects the panty portion to the stocking portions, is highly stretched when the panty portion receives the abdomen, the waist and the hip of a person. Then, due to the excessive stretch of the thigh portion, the person who wears the goreless panty-hose may feel uncomfortable. Especially when a wearer is fat or when a wearer sits down, since the stretch of the material is increased and the waist line of the panty-hose is deflected, the wearer may feel uncomfortable. Furthermore, sometimes, the seamed portion positioned at the crotch portion of the panty-hose may be damaged when it is excessively stretched due to the movement of the wearer. In addition wearers may feel uncomfortable when wearing the goreless panty-hose, since the above-mentioned goreless panty-hose have a seam line positioned at the crotch portion thereof.

To obviate the above-mentioned problems, some of the panty-hose manufacturers manufacture gored panty-hose which have gores at the crotch portions thereof. In these case, since seam lines between the gore material and the stocking materials curve, the seaming operation of the gored panty-hoses is manually effected by skilled sewers. Therefore, the productivity of the gored panty-hose is lower than that of the goreless panty-hose, and the cost of the gored panty-hose becomes higher than that of the goreless panty-hoses. Therefore, a method and apparatus for automatically seaming gored panty-hose have been desired.

SUMMARY OF THE INVENTION

An object of the present invention is to provide a method and apparatus for automatically seaming gored panty-hose with high productivity which method and apparatus have been desired as mentioned above.

Another object of the present invention is to provide a method and apparatus for seaming cut flaps of a pair of stocking materials and gore flaps, which gore has been preshaped in a diamond shape and folded in two, wherein the gore is inserted into a thigh portion of the stocking materials after the stocking materials which are held in an overlapping condition are cut to the thigh portion thereof.

A further object of the present invention is to provide a method and apparatus for seaming gored panty-hose wherein a pair of stocking materials which are held in an overlapping condition and which are cut to the thigh portion thereof are spread out so that the cut edges thereof are positioned along a reverse V-shape before a gore material of a diamond shape is inserted into the thigh portion of the pair of the stocking materials, and wherein the cut edges of the stocking materials which are exposed outward are positioned in a substantially straight condition after the core material is inserted.

A still further object of the present invention is to provide a method and apparatus for seaming gored panty-hose wherein a pair of cut flaps of stocking material and a flap of gore material are folded outward, and wherein the remaining cut flaps of the remaining stocking material and the remaining flaps of the core material are sewn.

Briefly, the invention provides a method and apparatus for seaming panty-hose having gore of a diamond shape.

In accordance with the method, a pair of stocking materials formed in a cylindrical shape are initially held so as to align the sides of the stocking materials with each other. Overlapped central portions of the stocking materials are then cut to a thigh portion of each material. Thereafter, the cut edges of the stocking materials are spread out until they are aligned in a reverse V-shaped condition and then, while the cut edges are held, two cut flaps of the stocking materials are vertically separated from each other. Next, a folded gore of diamond shape is inserted into a clearance formed between the two separated cut flaps. At this time, the folded gore of diamond shape is inserted into a clearance formed between the two separated cut flaps. At this time, the folded gore is held with the stocking materials and a first gore flap and the flap of one of the stocking materials are folded outwardly. The remaining gore flap and edges of the stocking materials are then aligned in a substantially straight line condition and seamed on a first sewing machine while being held. Thereafter, the seamed gore flap and stocking material flap are folded outwardly and the first gore flap and the flap of the first stocking material are seamed on a second sewing machine wile the gore and stocking materials are held.

The apparatus of the invention uses a plurality of template units which are mounted for movement in an endless path. Each unit includes a first and a second support member, each of which includes a template assembly comprising a pair of templates disposed in overlapping relation as well as a means for positioning the support members in three positions. In a first position, the template assemblies of the two support members are substantially parallel. In a second position, the template assemblies are aligned in a substantially straight line condition and in a third position the template assemblies are aligned in a reversed V-shaped condition. In addition, the apparatus includes a cutter means for cutting overlapping corresponding portions of a pair of stocking materials mounted between the template assemblies along a predetermined line for a predetermined length and a means for inserting a gore material having a diamond shape and folded in two into a clearance between cut flaps of the stocking materials mounted on the template assemblies. Also, the apparatus has a first sewing machine for seaming a first flap of the inserted gore material and a flap of one stocking material and a second sewing machine for seaming a flap of the gore material and a flap of the other stocking material.

Embodiments of the present invention will be explained in detail hereinafter with reference to the accompanying drawings.

BRIEF DESCRIPTION OF THE DRAWINGS

FIG. 1 is a perspective view which is used for explaining the conventional method for seaming goreless panty-hose;

FIGS. 26A through 26Z are used for explaining the operation of the apparatus of the first embodiment according to the present invention, in which FIGS. 26A through 26D, 26F, 26H, 26J, 26L, 26N, 26P, 26R, 26T, 26V, 26X and 26Z are plan views and FIGS. 26E$_1$, 26E$_2$, 26G, 26I, 26K, 26M, 26O, 26Q, 26S, 26U, 26W and 26Y are cross sectional side views;

FIGS. 28A through 28J are used to explain the operation of the embodiment illustrated in FIG. 27, in which FIGS. 28A, 28B, 28G and 28H are perspective views, FIGS. 28C, 28D, 28I and 28J are cross sectional side views, and FIGS. 28E and 28F are plan views.

DETAILED DESCRIPTION OF THE INVENTION

Prior Art

First, the above-mentioned conventional method for seaming goreless panty-hose will be briefly explained with reference to the accompanying FIGS. 1A through 1D. A pair of stocking materials 1 and 2 are held together by nipping them together along lines 3 and 4. Under this nipped condition, they are sliced along a line 5 which runs between the two lines 3 and 4 (see FIG. 1A). After this slicing, the open ends of the stocking materials 1 and 2 are spread laterally in a direction perpendicular to the nip so as to open the sliced part (see FIG. 1B). in the finished panty-hose, the sliced part must be seamed as shown by lines 3*a* and 4*a* in FIG. 1C.

Outline of the Method according to the Present Invention

Figure 2A:
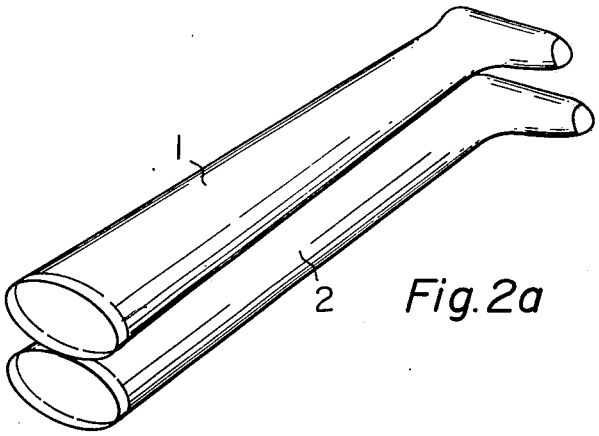
FIG. 2 is a perspective view which is used for explaining the method of the present invention for seaming gored panty-hose having gores of a diamond shape.
Figure 2B:
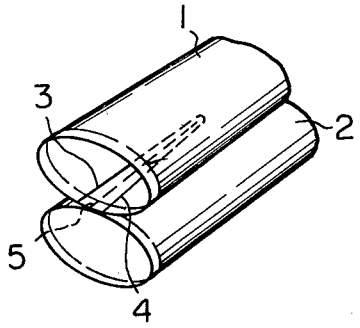
Figure 2C:
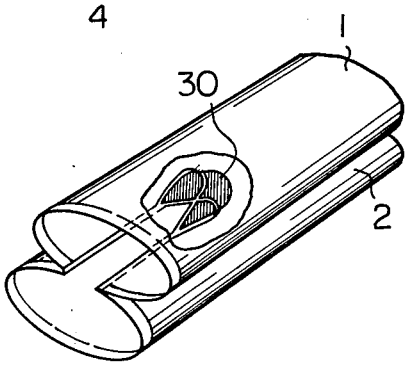
Figure 2D:
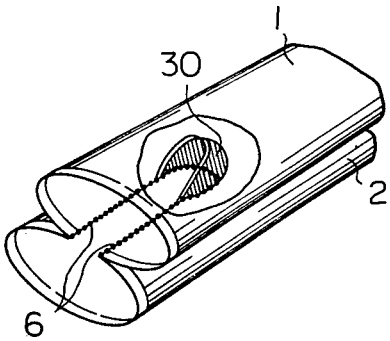
Figure 2E:
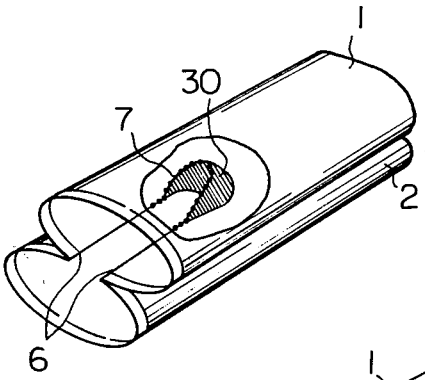
Figure 2F:
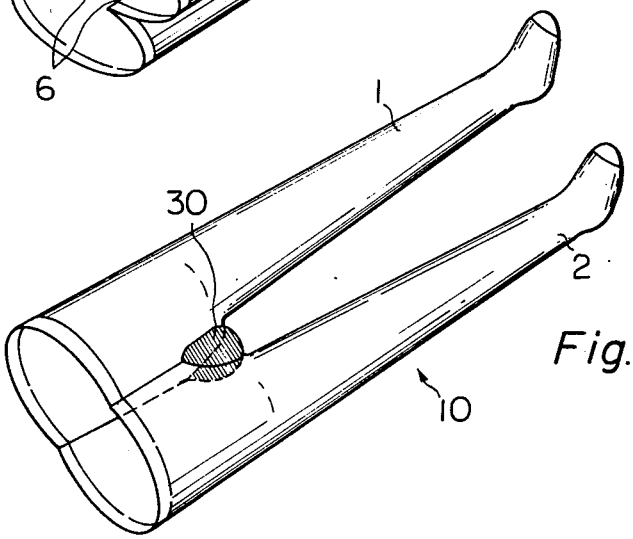

The panty-hose according to the above-mentioned conventional method, however, have no gores at the crotch portions thereof and cause the previously described problems. The present invention which is provided to obviate the above-mentioned problems will now be outlined with reference to the accompanying FIGS. 2A through 2F. As shown, a pair of stocking materials 1 and 2 are held together by nipping them together along lines 3 and 4. Under this nipped condition, they are sliced along a line 5 which runs between the two lines 3 and 4 (see FIG. 2B). After this slicing the open ends of the stocking materials 1 and 2 are spread laterally in a direction perpendicular to the nip so as to open the sliced part. Then, a diamond shaped gore, folded in two, is inserted between the open sliced thigh portions of the stocking materials. Then a seaming operation consisting of two sewing steps is applied along the nip lines 3 and 4 by means of two sewing machines. In the first sewing step, a seaming operation is effected along a seam line 6, which extends from an opening end of the stocking materials to the other opening end of the stocking materials through the thigh portion where a gore flap is overlapped with the cut flaps of one of the stocking materials as illustrated in FIG. 2D. Then, the other gore flap and cut flaps of the other stocking material, which flaps are positioned at the thigh portion, are seamed along a seam line 7 as illustrated in FIG. 2E, and a finished panty-hose which has a gore at the crotch portion thereof, as illustrated in FIG. 2F, is obtained. The steps illustrated in FIGS. 2D and 2E can be effected in reverse order. The seaming of the gore flap and the cut flaps of the stocking material can be effected from the upper flaps to the lower flaps and vice versa. As is illustrated in FIG. 2, since the gored panty-hose have a gore seamed at the crotch portion thereof, it is very troublesome and difficult to effect the sewing operation in the condition illustrated in FIGS. 2D and 2E.

To obviate this difficulty, in the present invention, the V-shaped cut edges are spread out to a reverse V-shape condition while the cut edges are held. Then a gore, folded in two, is inserted into a clearance between the held cut edges and the held cut edges are returned to a substantially straight line condition. As a result, the cut flaps of the stocking materials and the gore flaps where seam lines extend are exposed outward and the seam lines become substantially straight so that the sewing operation of the stocking materials and the gore material can easily be effected.

Outline of the Apparatus according to the Present Invention

Figure 3:
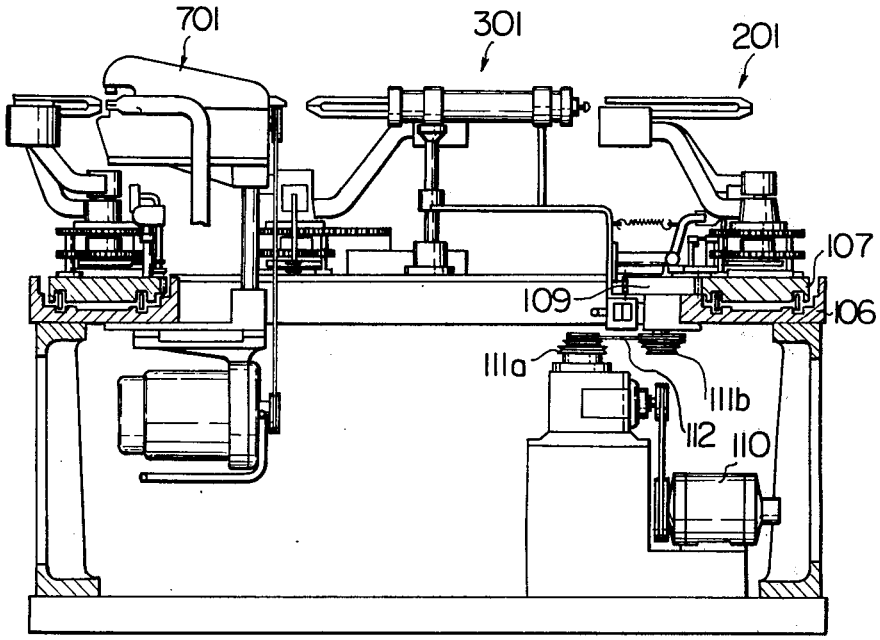
FIG. 3 is a side view of the apparatus according to the present invention.
Figure 4:
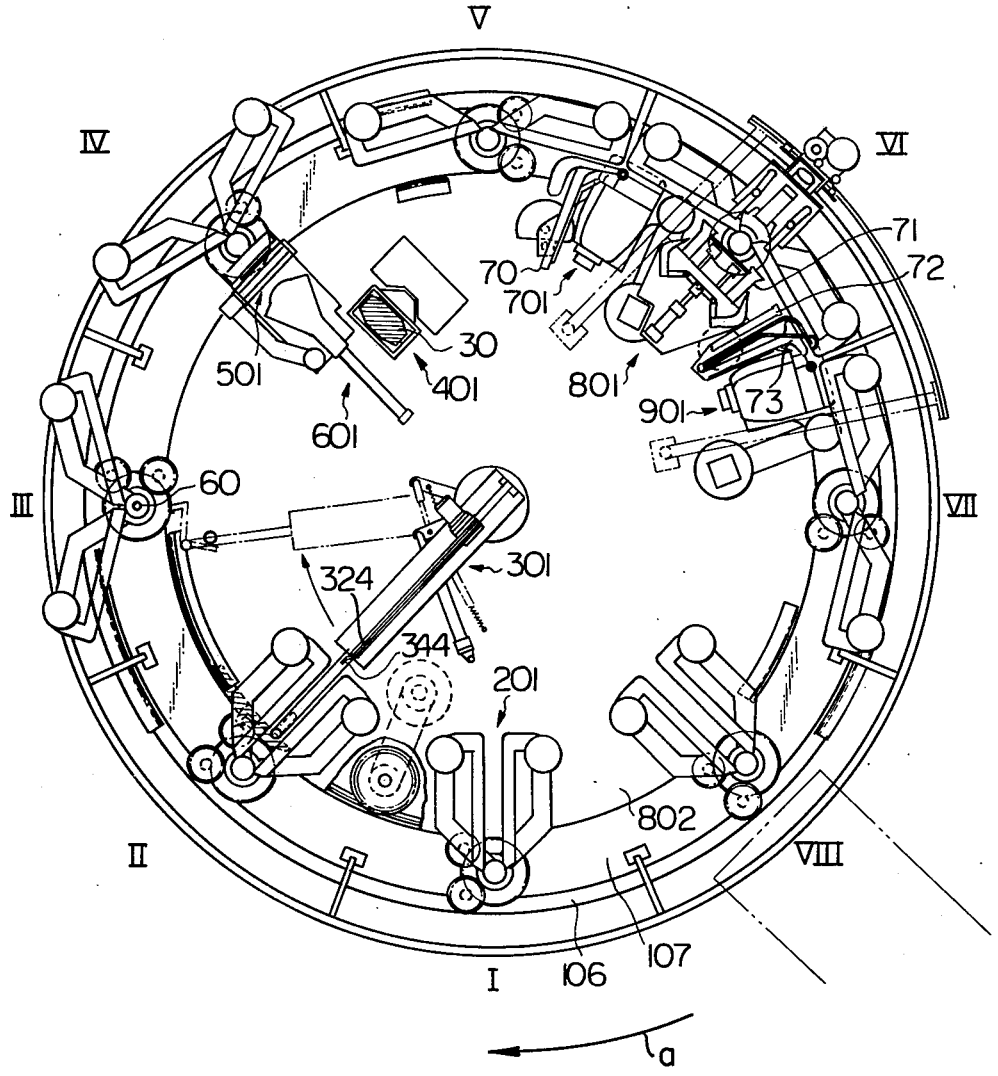
FIG. 4 is a plan view of the apparatus illustrated in FIG. 3.

With reference to FIGS. 3 and 4, a stationary guide rail 106 is constructed in an endless circular form. A circularly elongated carrier 107 is mounted on the guide rail 106 in a slidable arrangement along the guide rail 106.

As is seen in FIG. 4, the carrier 107 is provided with several template units 201 mounted thereon at prescribed distances. In the case of the illustrated embodiment, eight template units 201 are mounted on the carrier 107 at equal distances from each other. It will be understood that the number of the template units 201 on the carrier 107 can be selected as desired in accordance with the requirement in the actual process. Further, in the arrangement shown in FIG. 4, the template units 201 mounted on the carrier 107 are supposed to travel in a direction shown by an arrow "a", i.e. in the clockwise direction in the illustration. Each template unit 201 is capable of being positioned at eight stations I through VIII located along the guide rail 106. Each template unit 201 is supplied with a pair of stocking materials at the station I and carries them to the other stations. After the stocking materials are cut to the thigh portion thereof by means of a cutter device 301, which is movable with the carrier 107 while the stocking materials are moving between the station II and III, the thigh portion of the overlapped stocking materials is spread outward. At the station IV, a diamond shaped gore, supplied from a gore supply member 401, is grasped by means of a gore grasping member 501 and inserted between the overlapped spread out stocking materials by means of a gore insert member 601. The lower flap of the folded gore and the cut flaps of the lower stocking materials are folded, and then grasped by the lower portion of template assemblies of the template unit 201, by means of a folding guide member which is disposed on the gore insert member 601. Then, while the template unit 201 is moved from the station IV to the station V, the template assemblies of the template unit 201 are returned to a substantially straight line condition. The cut flaps of the upper stocking material and the upper gore flap are sewn by means of a first sewing machine while they move from the station V to the station VI. A folding device 801, which folds upward and secures the seamed cut flaps of the upper stocking material and the upper gore flap, is disposed at the station VI. A part of the folding device 801 is capable of movement with the template unit 201 between the stations VI and VII. After the cut flaps of the upper stocking material and the upper gore flap are folded upward and secured by means of the folding device 801, the cut flaps of the lower stocking materials and the lower gore flap are released from the lower portion of the template assemblies the template unit 201. The overlapped cut flaps of the stocking materials, and the released seamed cut flaps of the lower stocking material and lower gore flap are sewn by means of a second sewing machine 901. The template assemblies of the template unit 201 are returned to the original position while they move from the station VII to the station VIII. At the station VIII, the gored panty-hose are taken up from the template unit 201 by means of a take up mechanism (not shown) which has a similar construction to that of a removal mechanism disclosed in the U.S. Pat. No. 3,777,681.

Carrier

Figure 5:
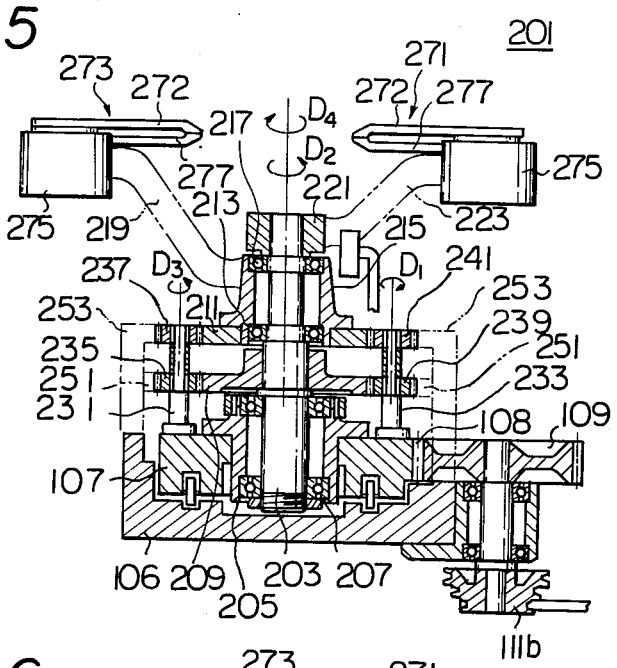
FIG. 5 is a side view of a template unit mounted on the apparatus illustrated in FIG. 4.

As mentioned above, the carrier 107 is movably disposed on the stationary guide rail 106. Referring to FIGS. 3 and 5, the inside periphery of the carrier 107 is provided with a continuously elongated rack 108, which meshes with a drive gear 109. The drive gear 109 is connected to a drive motor 110 for rotation via stepped pulleys **111*a* and 111*b* and a belt 112. Rotation of the drive gear 109 causes the travel of the carrier 107 along the guide rail 106. The motor 110 may be provided with suitable control means (not shown), which controls the mode of rotation of the drive motor 110. For example, the drive motor 110 may cause an intermittent movement. In one example, a micro-switch (not shown) is located at a suitably selected position of the guide rail 106, which micro-switch is connected to an electric circuit accompanying the drive motor 110. Further, the micro-switch is communicated with a suitable time switch. Separately from this, the carrier 107 is provided with an operator-pin (not shown) mounted on a suitably selected position thereof. As the carrier 107 travels along the guide rail 106, the operator-pin of the carrier 107 operates on the micro-switch on the guide rail 106 so as to stop the driving motor 110. The driving motor 110 is kept inoperative over the period adjusted by the time switch. After a prescribed time has passed, the time switch again functions so as restart the driving motor 110 and the carrier 107 starts to again travel along the guide rail 106**.

Template unit

The details of the structure of the template unit 201 will now be explained with reference to FIGS. 5 and 6, wherein an upright main shaft 203 is rotatably mounted on the carrier 107 via a cylindrical base 205 and bearings 207. The cylindrical base 205 is fixed to the carrier 107. At a position just above the upper end of the base 205, a lower gear 208 is fixedly mounted on the main shaft 203 and, at a position above the lower gear 209, an upper gear 211 is rotatably mounted on the main shaft 203 via a bearing 213. In one body with this upper gear 211, a collar 215 is rotatably mounted on the main shaft 203 via a bearings 217, which collar 215 has a lower arm 219 radially extending therefrom. Above the collar 215, another collar 221 is fixedly mounted on the main shaft 203, which collar 221 has an upper arm 223 radially extending therefrom. Due to this structure, the lower arm 219 is free from the rotation of the main shaft 203 whereas the upper arm 223 turns about the axis of the main shaft 203 upon rotation of the latter.

Spaced from and in parallel to the main shaft 203 are a pair of upright auxiliary shafts 231 and 233 which are fixed on the carrier 107. The auxiliary shaft 231 is provided with a lower gear 235 and an upper gear 237, both being rotatably inserted over the shaft 231. The lower gear 235 meshes with the lower gear 208 of the main shaft 203, whereas the upper gear 237 meshes with the upper gear 211 of the main shaft 203. The other auxiliary shaft 233 is provided with a lower gear 239 and an upper gear 241, both being rotatably inserted over the shaft 233. The lower gear 239 meshes with the lower gear 209 of the main shaft 203 whereas the upper gear 241 meshes with the upper gear 211 of the main shaft 203.

Figure 6:
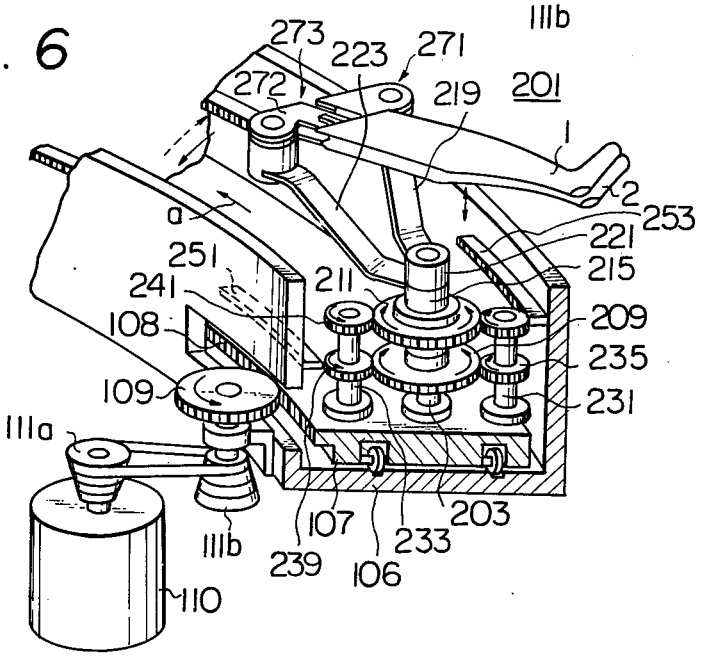
FIG. 6 is perspective view of the template unit illustrated in FIG. 5.

As is seen in FIG. 6, the internal surfaces of the upright walls of the guide rail 106 are provided with horizontally running racks 251 and 253. The location and length of the racks 251 and 253 are suitably selected in accordance with the mode of operation to be performed by the apparatus of the present invention. Vertical levels of the racks 251 and 253 are so designed that they mesh the gears 235, 237, 239 and 241 of the auxiliary shafts 231 and 233 as the carrier 107 travels along the guide rails 106.

One example of this meshing mode is illustrated in FIG. 5. Following the advancement of the template unit 201 in the direction of the arrow "a" in FIG. 6, the lower gear 239 of the auxiliary shaft 233 (right side shaft in FIG. 5) comes into meshing engagement with the right side rack 251 and rotates in the direction "$D_1$" in FIG. 5. Upon this rotation of the lower gear 239, the main shaft 203 rotates in the direction "$D_2$" due to the meshing engagement between the lower gears 209 and 239. This rotation of the main shaft 203 naturally causes turning of the upper arm 223, and its associated template assembly 271. In synchronism with this operation, the upper gear 237 of the auxiliary shaft 231 (left side shaft in FIG. 5) comes into meshing engagement with the left side rack 253 and rotates in the direction "$D_3$". Upon this rotation of the upper gear 237, the collar 215 rotates in the direction "$D_4$" due to the meshing engagement between the upper gears 211 and 237. This rotation of the collar 215 naturally causes turning of the lower arm 219 and its associated template assembly 273.

Figure 7:
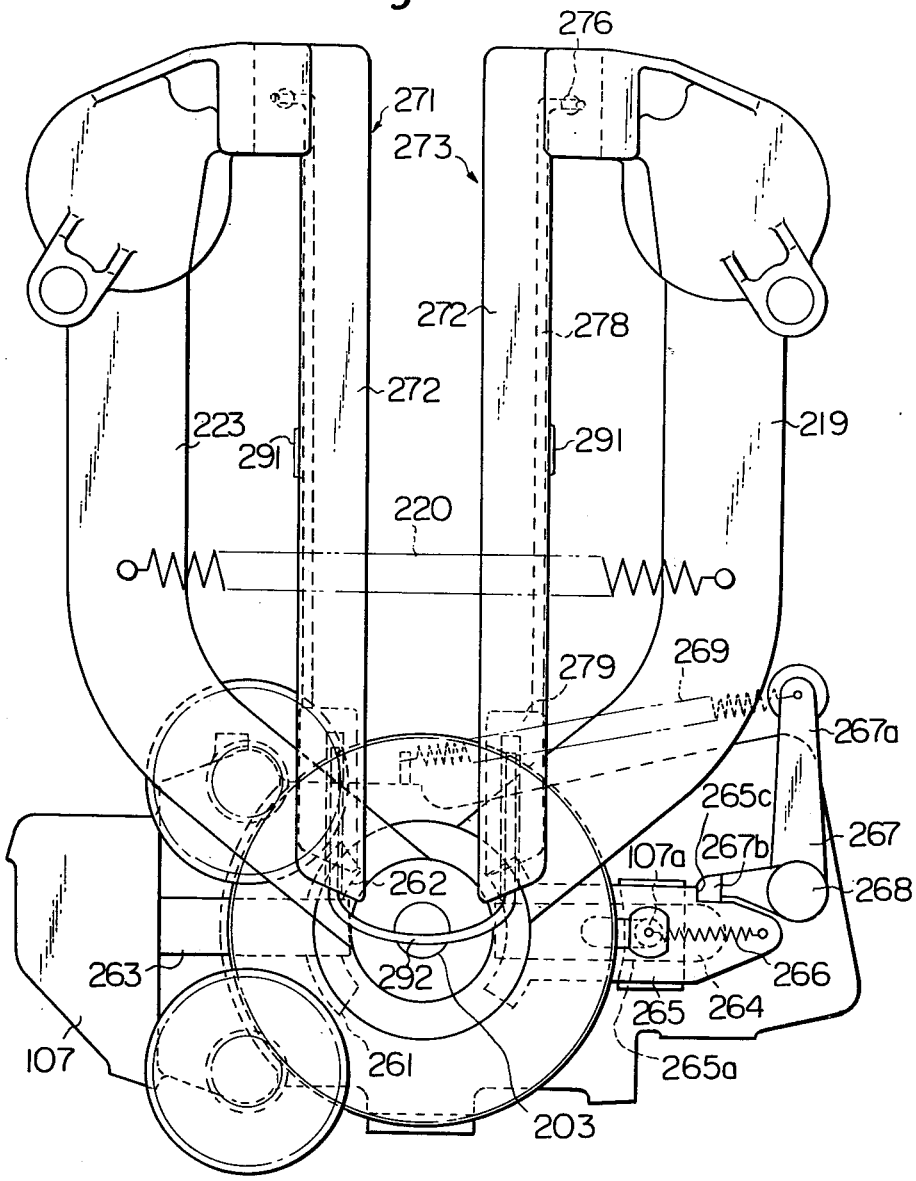
FIG. 7 is a plan view of a pair of template assemblies mounted on the template unit illustrated in FIG. 5.
Figure 8:
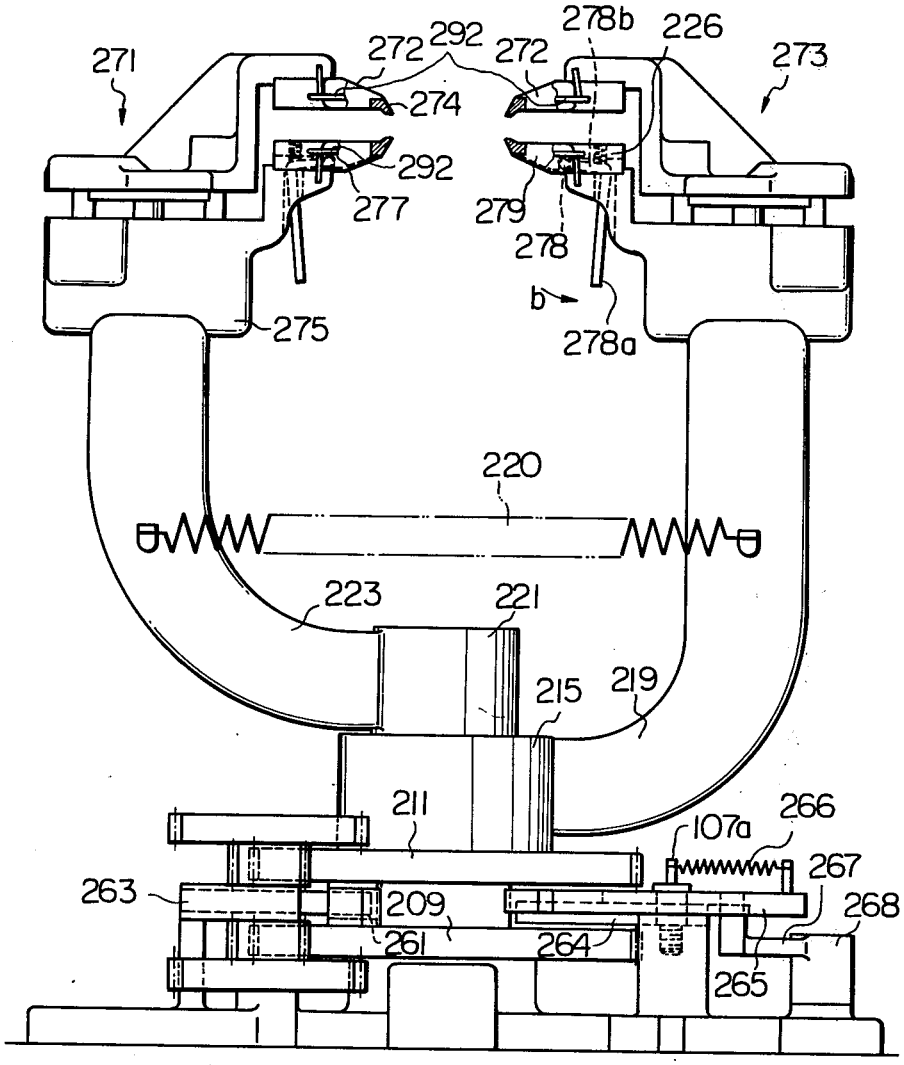
FIG. 8 is a side view of the template assemblies illustrated in FIG. 7.

Further advancement of the template unit 201 meshes the upper gear 241 of the right side auxiliary shaft 233 with the right side rack 253 and the lower gear 235 of the left side auxiliary shaft 231 with the left side rack 251. This re-meshing of the gears makes the template assemblies 271 and 273 turn in opposite directions. The template assemblies 271 and 273 of the present invention must be positioned at a first position where they are parallel to each other, a second position where they are aligned in a substantially straight line condition and a third position where they are aligned in a reverse V-shaped condition. For this purpose, abutments which are fixed to the lower gear 209 and the upper gear 211 of the main shaft come into abutment with a movable stop so that the assemblies 271 and 273 can be positioned at the above-mentioned three positions. With reference to FIGS. 7 and 8, an abutment 261 is fixed on the upper surface of the lower gear 209 mounted on the main shaft 203 (FIG. 5) and an abutment 262 is fixed on the lower surface of the upper gear 211. The carrier 107 is provided with stationary stops 263 and 264, and a slidable stop 265 which has a groove **265*a* for slidably engaging with the stationary stop 264 at the lower surface thereof and which is formed in a T-shape. A pin 107*a* which is fixed to the carrier 107 and which projects through an opening 265*a* formed on the slidable stop 265, is provided with a tension spring 266 for urging the slidable stop 265 toward the main shaft 203 (FIG. 7). The slidable stop 265 has a notch 265*c* formed thereon. A L-shaped lever 267 swingably pivoted on the carrier 107 by means of a pin 268 fixed on the carrier 107 is provided with an end 267*a* which is urged by a tension spring 269 in a counterclockwise direction and another end which engages with the notch 265*c*. When the arms 219 and 223 are swung from the condition shown in FIG. 7, as mentioned above, the abutments 261 and 262 come into abutment with ends of the T-shaped stop 265 by the spring force of a tension spring 220 which is disposed between the arms 219 and 223. As a result the arms are positioned at a predetermined position (the second position). When one end 267*a* of the L-shaped lever is swung in a clockwise direction, the other end 267*b* of the lever 267 is released from the notch 265*c* of the T-shaped stop 265. When the arms 219 and 223 are swung and the abutments 261 and 262 come into abutment with the ends of the T-shaped stop 265, the T-shaped stop 265 is moved backward due to the urging force of the tension spring 220 which is disposed between the arms 219 and 223. As a result, the abutments 261 and 262 come into abutment with the stationary stop 264, and then, the arms 219 and 223** are positioned at the third position.

Figure 10:
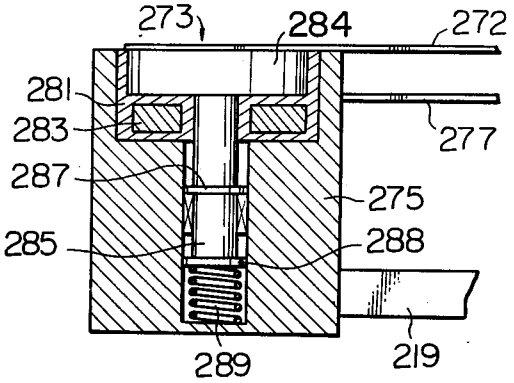
FIG. 10 is a cross sectional side view of a clamping mechanism of the template assembly.

Referring to FIG. 10, a detail structure of an embodiment of the template assembly 271 or 273 with its related parts is illustrated. In the illustrated structure, the cylinder 275 is fixed to the outer end of the lower arm 219 (FIG. 8) and the lower template 277 extends radially from the cylinder surface. Inside the cylinder 275, a centrally bored electric actuator 281 is fixedly inserted. Further, an electric magnet 283 is embedded within the electric actuator 281 which is communicated with the corresponding electric supply mounted along the guide rail 106 for supplying electric current. In the central bore of the electric actuator 281, a flange 284 is slidably inserted and is provided with a downwardly integral pole 285, which pole extends through a center hole of the cylinder 275. The pole 285 is provided with a stopper flange 287 at the midway portion thereof and an abutment 288 at the lower end thereof. A compression spring 289 is inserted between the abutment 288 and the closed bottom end of the center hole of the cylinder 275. The pole 285 is provided with suitable bearing for a smooth sliding threof through the center hole of the cylinder 275. The upper template 272 is fixed to the upper face of the flange 285.

When the electric actuator 281 is inoperative, i.e., the electro-magnet 283 is deactivated, the flange 284 is projected upwardly from the cylinder 275 being urged by the spring force of the spring 289. This exposure is limited to a prescribed extent by a contact of the stopper flange 287 with the bottom face of the electric actuator 281. In this disposition, the upper template 272 is kept away from the lower template 277. Upon activation of the electric magnet 283, the electric actuator 281 attracts the flange 284 downwardly overcoming the spring force of the spring 289. Then the upper template 272 fixed on the flange 284 moves downward into pressure contact with the lower template 277 so as to nip the stocking materials together.

Referring to FIGS. 7 through 9 again, the template assemblies 271 and 273 will now be explained in detail hereinafter. In FIG. 7, the template assemblies 273 and 271 connected to the arms 219 and 223 are parallel to each other, in FIG. 8, the upper and lower templates 272 and 277 are also parallel to each other. The nip portions for nipping the stocking materials of the templates 272 and 277 are provided with nip tips 274 made of non-abrasive material having a high coefficient of friction, which tips are glued on the templates. The tips 274 are scraped for a predetermined length and depth at the front end thereof, which is remote from the arm 219 or 223. Consequently, a small clearance is formed between the upper template 272 and the lower template 277 when the upper template 272 is lowered, due to the actuation of the electric actuator 281 (FIG. 9) mounted within the cylinder 275, and the gore material folded in two can easily be inserted into the clearance.

Figure 9:
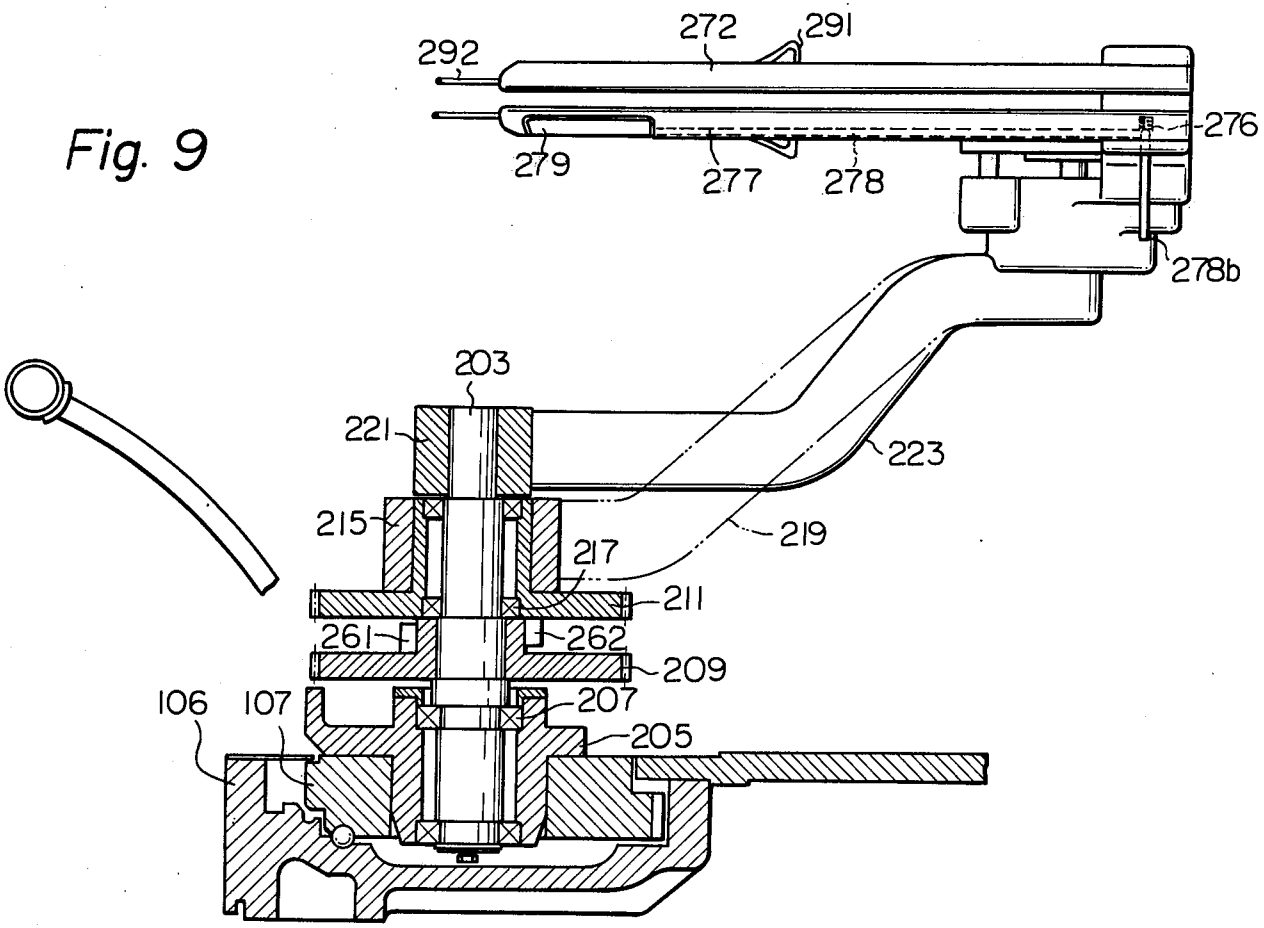
FIG. 9 is an elevational view of the template assemblies illustrated in FIG. 7.

As illustrated in FIG. 9, escape guards 291 made in a triangular shape, which is inclined to the front end of the template 272 or 277, are fixed to the upper surface of the upper template 272 and the lower surface of the lower template 277 at the central portion of the templates. As a result, the stocking materials are prevented from escaping from the templates 272 and 277 when the template assemblies 271 and 273 are spread out.

In addition, the lower template 277 is provided with a flap 279, which is swingably mounted around a swing shaft 278 extending along length of the template 277, at the lower front portion of the lower template 277. The swing shaft 278 extends in a groove formed on the lower surface of the lower template 277 and reaches the root of the lower template 277 when the swing shaft 278 is bent horizontally and then is bent vertically so that the end 278*a* of the swing shaft 278 projects from the lower template 277. The horizontal bent portion 278*b* of the swing shaft 278 is urged by a compression spring 276. As a result, the flap 279 is normally urged toward the lower template 277 due to the urging force of the compression spring 276, and the cut flaps of the stocking material and the gore flap can be held together between the flap 279 and the lower template 277 as will be explained later. When the end 278*a* of the swing shaft 278 is swung in a direction shown by arrow b (FIG. 8), the flap 279 is open and releases the gore flap and the cut flaps of the stocking material. The parallel upper templates 272 and the parallel lower templates 277 have small holes at the front ends thereof and two flexible rods 292 (FIG. 7) of plastic inserted in the holes, so that the stocking materials can easily be mounted on the templates 272 and 277.

It should be noted that in FIG. 8 intermediate gears are disposed between the gears 233, 235, 239 and 241 of the auxiliary shaft 231 and 233 and the racks 251 and 253 illustrated in FIGS. 5 and 6, so as to facilitate the smooth operation of the machine.

Cutter Device

Figure 11:
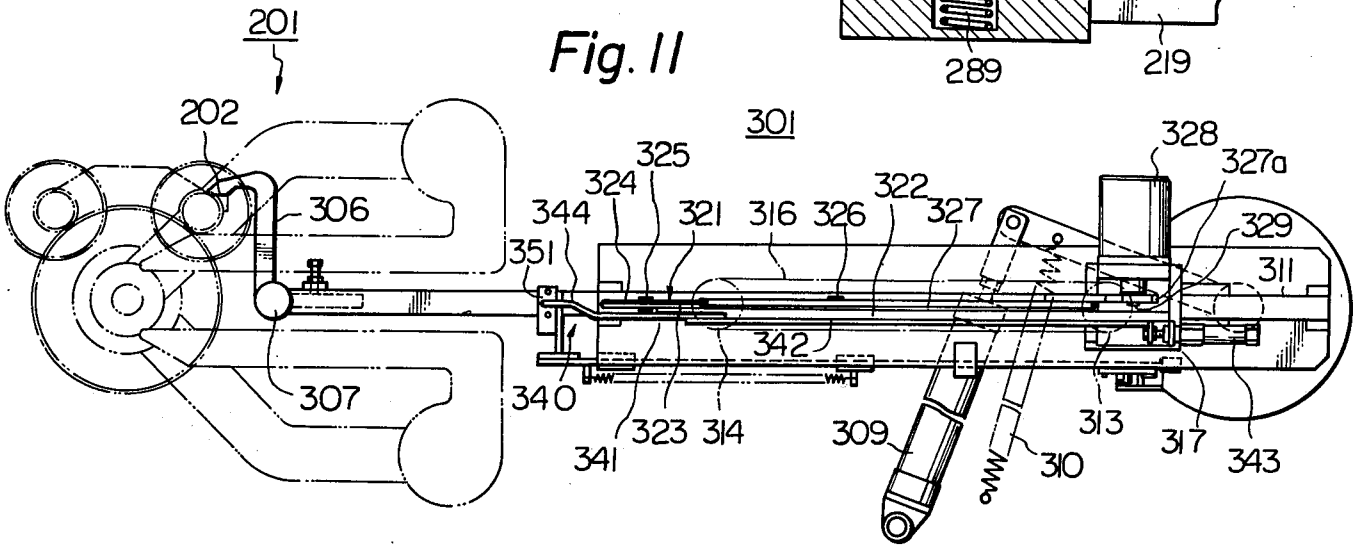
FIG. 11 is a plan view of a cutter device.
Figure 12:
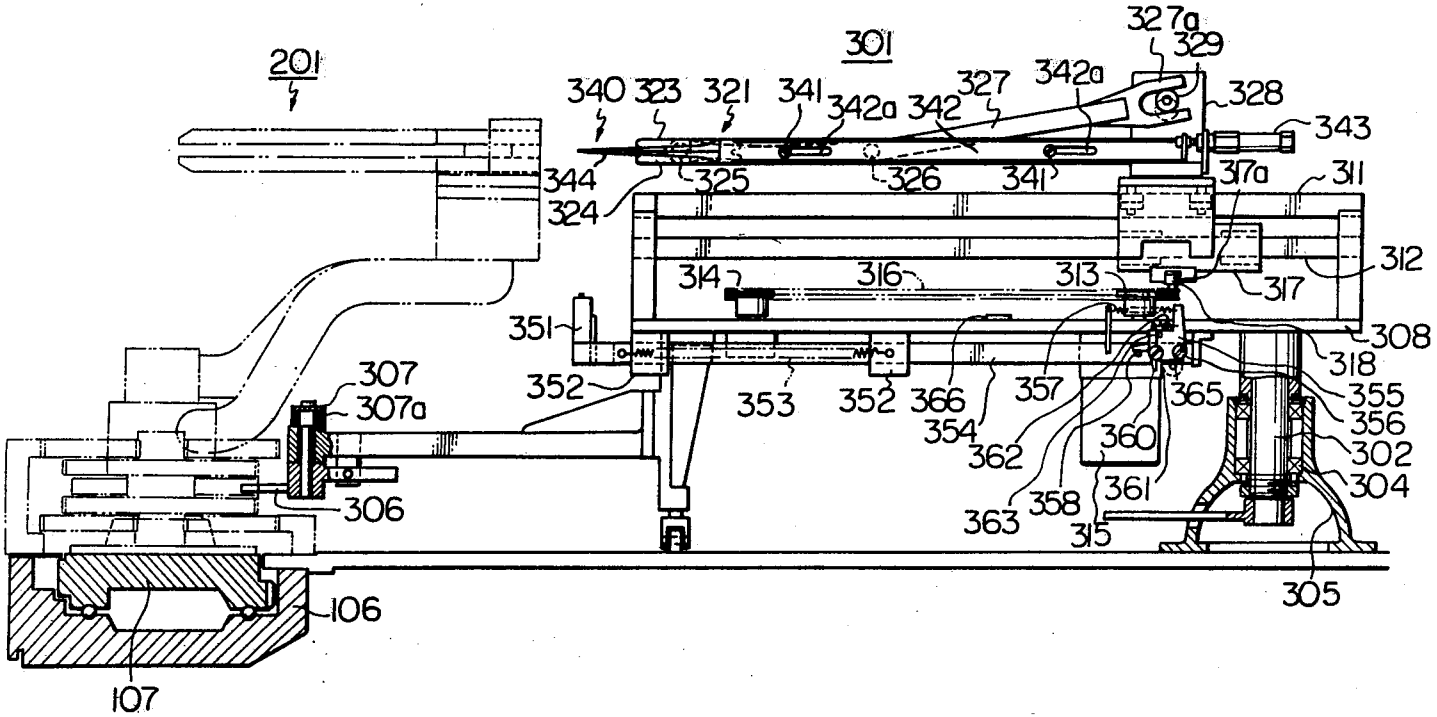
FIG. 12 is a side view of the cutter device.

As already explained with reference to FIG. 4, slicing of the stocking materials mounted on the template unit 201 is carried out by the cutter device 301 when the template unit 201 passes through the stations II and III. An embodiment of the cutter device 301 for effecting this slicing operation is illustrated in FIGS. 11 and 12. When this slicing operation is considered, the fact must be noted that, because the slicing should be completed without any interception of the travelling movement of the template unit 201, the cutter device 301 must turn in synchronism with the travelling of the template unit 201, i.e. the circulating speed of the carrier 107. In the case of the illustrated embodiment, the cutter device 301 must turn about the center of the circular guide rail 106 over a prescribed distance for a prescribed period. For this purpose, as illustrated in FIG. 12, the cutter device 301 is swingably supported around the center of the guide rail 106 by supporting the spindle 302 thereof which is fixed to an elongated bracket 308 thereof via bearings 204 which are mounted on an bracket 305. The front end of the elongated bracket 308 has a Z-shaped lever 306 (FIG. 11) horizontally and swingably pivoted via a boss 307 which has a coil spring 307*a* mounted therein for urging the Z-shaped lever 306 (FIG. 12) in a counterclockwise direction in FIG. 11. As a result, the front end of the Z-shaped lever 306 engages with a cam surface 202 formed on the template unit 201, and then, the cutter device 301 is synchronized with the template unit 201 and is swung. When the cutter device 301 reaches the predetermined position, the tail end of the Z-shaped lever is pressed against a pin (not shown) disposed on the stationary portion, and then, the lever 306 is clockwisely swung and the cutter device 301 is disengaged from the template unit 201. Since the cutter device 301 is urged toward the station II by means of a tension spring 310, the cutter device returns to the station II. A hollow cylinder 309 is used for absorbing the shock caused by the returning of the cutter device 301 to the station II by utilizing a flow controller (not shown) for adjusting the exhaust air flow caused by the movement of a piston (not shown), which is slidably mounted within the cylinder 309, so that the return speed of the cutter device is adjusted to a predetermined speed.

Two guides 311 and 312 are horizontally mounted on the elongated bracket 308 and along the length of the bracket 308. A cutter head 317 is slidably mounted on the guides 311 and 312. The elongated bracket 308 has a pair of sprocket wheels 313 and 314 rotatably mounted thereon, and the sprocket wheel 313 is driven by a motor 315 which has a reduction gear therein. Endless chains 316 are disposed between the sprocket wheels 313 and 314, and one link of the chains 316 has a guide roller 318 rotatably mounted thereon. The lower surface of the cutter head 317 has a groove 317*a* (FIG. 12) formed thereon which is positioned perpendicular to the length of the elongated bracket 308 and which engages with the guide roller 318. As a result, when the motor 315, which has a reduction gear, is rotated in one direction and the guide roller 318 is moved along an elongated circular passage with the endless chain 316, the cutter head 317 is reciprocated.

The cutter device 301 has a cutter member 321 and an opener 340 for opening the cut flaps of the stocking materials. The cutter head 317 has a plate bracket 322 fixed thereto which extends along the length of the elongated bracket 308 and which has a stationary blade 323 at the front end and a movable blade 324 swingably mounted thereon via pin 325. The plate bracket 322 also has a swing lever 327 swingably mounted thereon via pin 326, which pin is fixed to the plate bracket 322 at the central portion thereof. The end 327*a* of the swing lever 327 is formed in a C-shape and has an eccentric roller 329 which is rotated by a motor 328. As a result, when the motor 328 is rotated and the eccentric roller 329 causes an eccentric movement, the swing lever 327 is reciprocated and the movable blade 324 is moved, and then, the slicing is effected between the stationary blade 323 and the movable blade 324.

Figure 13:
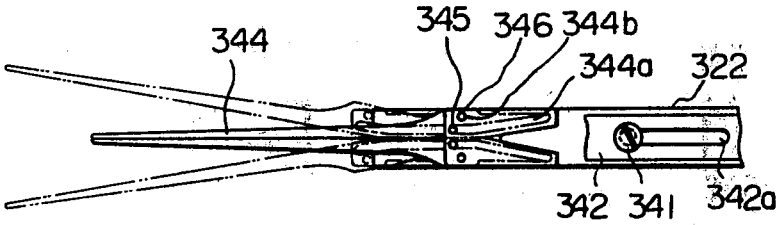
FIG. 13 is an enlarged side view of a pair of fingers of a cut-flap opener mounted on the cutter device.
Figure 14:
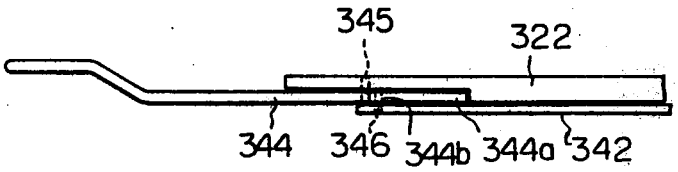
FIG. 14 is a plan view of the cut-flap opener.

The cut flap opener 340 is used to open the cut flaps of the stocking materials which are sliced by the cutter member 321 coacting with the spreading out operation of the template unit 201, so that the cut flaps are open outward and are prepared for insertion of the gore material, and the sewing operation of the cut flaps of the stocking materials and the gore flaps. As illustrated in FIG. 12, the cut flap opener 340 comprises a movable plate 342, which has two elongated holes 342*a* formed thereon with which two pins 341 fixed to the plate bracket 322 are engaged; a pneumatic cylinder 343, which reciprocates the movable plate 342 along the length of the elongated bracket 308, and; a pair of fingers 344 which are actuated by the reciprocating movement of the movable plate 342. As illustrated in FIGS. 13 and 14, the finger 344 has an inclined elongated groove 344*a* which engages with a pin 345 fixed to the plate bracket 322 and a circular hole 344*b* which engages with a pin 346 fixed to the movable plate 342. As a result, when the movable plate 342 is moved, the finger 344 is moved with the pin 346, and is swung around the pin 346 so that the pin 345 and the groove 344*a* are positioned at a predetermined positional relationship. Consequently, the front ends of the fingers 344 are open as illustrated by a dot-dash line in FIG. 13 as the movable plate 342 is advanced.

The cutter device 301 detects the stocking materials when the cut flap opener 340 reaches a position where the cut flap opener normally enters into the stocking materials, and the device 301 continues to cut and open the stocking materials only when the stocking materials are detected. The detecting operation is effected by means of a reflection type photoelectric detecting device 351 (FIG. 12) which moves with the cutter head 317. After the stocking materials are detected, the photoelectric detecting device 351 is moved backward, independent of the cutter head 317, so that the detecting device 351 is prevented from being damaged while the cutter device 301 returns to the station II. The lower surface of the elongated bracket 308 (see FIG. 12) has a pair of slide bearings 352 mounted thereon, which slidably support a guide 354. The guide 354 is provided with the reflection type photoelectric detecting device 351 at the front end thereof and a tension spring for urging the guide 354 backward. The rear end of the guide 354 has a reverse L-shaped bracket 355 swingably pivoted thereon via pin 356 and urged by a tension spring 357 connected to the guide 354 in a clockwise direction. The swinging amount of the bracket 355 is limited by a stop 358 fixed to the guide 354. The reverse L-shaped bracket 355 has an auxiliary bracket 360 swingably mounted thereon via pin 361, the upper end of which auxiliary bracket is urged by a tension spring 362 connected to the reverse L-shaped portion of the bracket 355 in a clockwise direction. The swinging amount of the auxiliary bracket 360 is limited by a stop pin 363 fixed to the reverse L-shaped bracket 355. When the lower right end of the auxiliary bracket 360 is pressed by means of a pin which is fixedly mounted on the cutter head 317 and which is moved forward, the guide 354 is moved forward with the cutter head 317. When the reverse L-shaped bracket 366 is knocked by a knocker 366 fixedly mounted on the elongated bracket 308, the reverse L-shaped bracket 355 is swung around the pin 356 in a clockwise direction, the pin 365 is released from the auxiliary bracket 360 and, then, the guide 354 is returned by the spring 353. When the pin 365 is moved backward toward the auxiliary bracket 360, the auxiliary bracket 360 is swung around the pin 361 in a counterclockwise direction so that the pin 365 can pass.

Gore Supply Member, Gore Grasping Member and Gore Insert Member

As mentioned above, at the station IV illustrated in FIG. 4, a diamond shaped gore supplied from the gore supply member 401 is grasped by means of the gore grasping member 501 and is inserted between the overlapped spread out stocking materials by means of the gore insert member 601. The lower flap of the folded gore and the cut flaps of the lower stocking material are folded and are grasped by the above-mentioned flap 279 (FIGS. 7 through 9) of the template unit 20.

Figure 15:
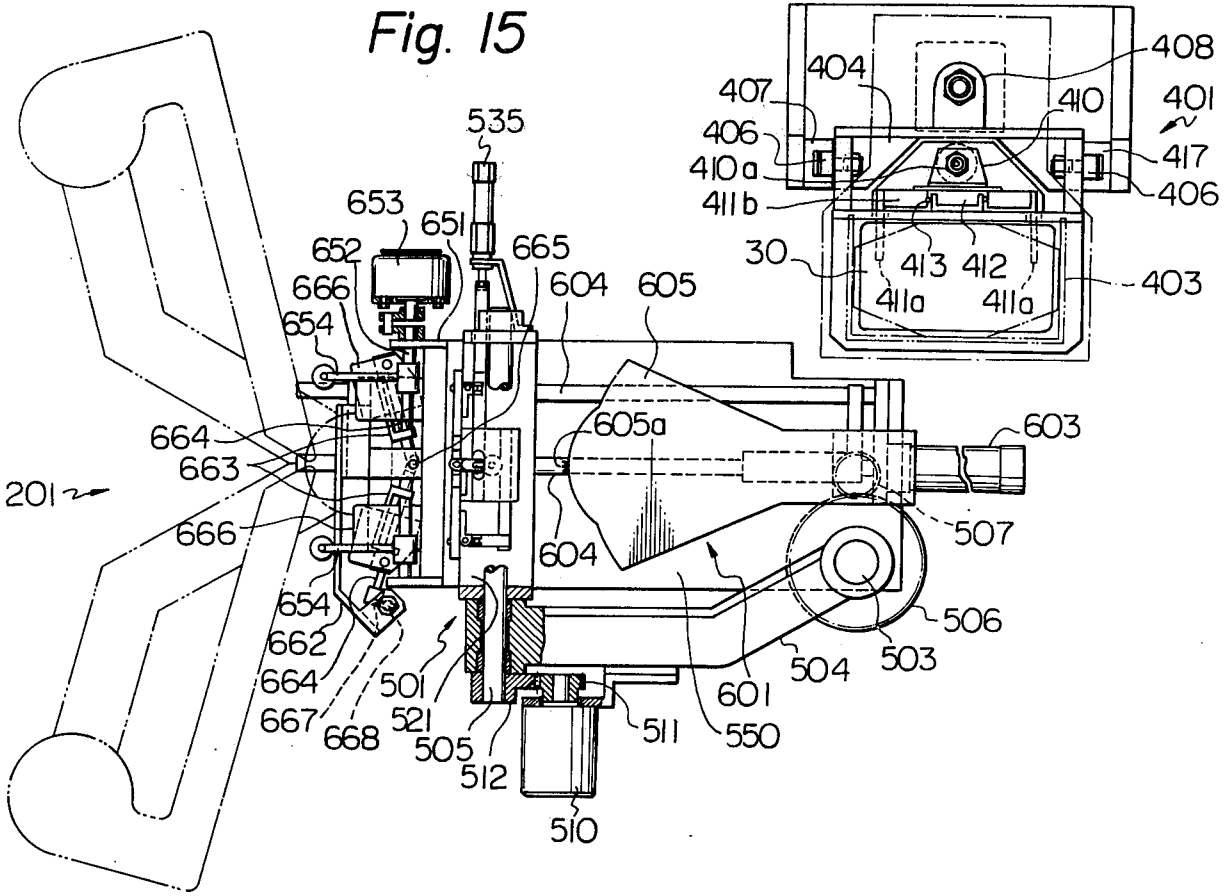
FIG. 15 is a plan view of a gore supply member, a gore grasping member and a gore insert member.
Figure 17:
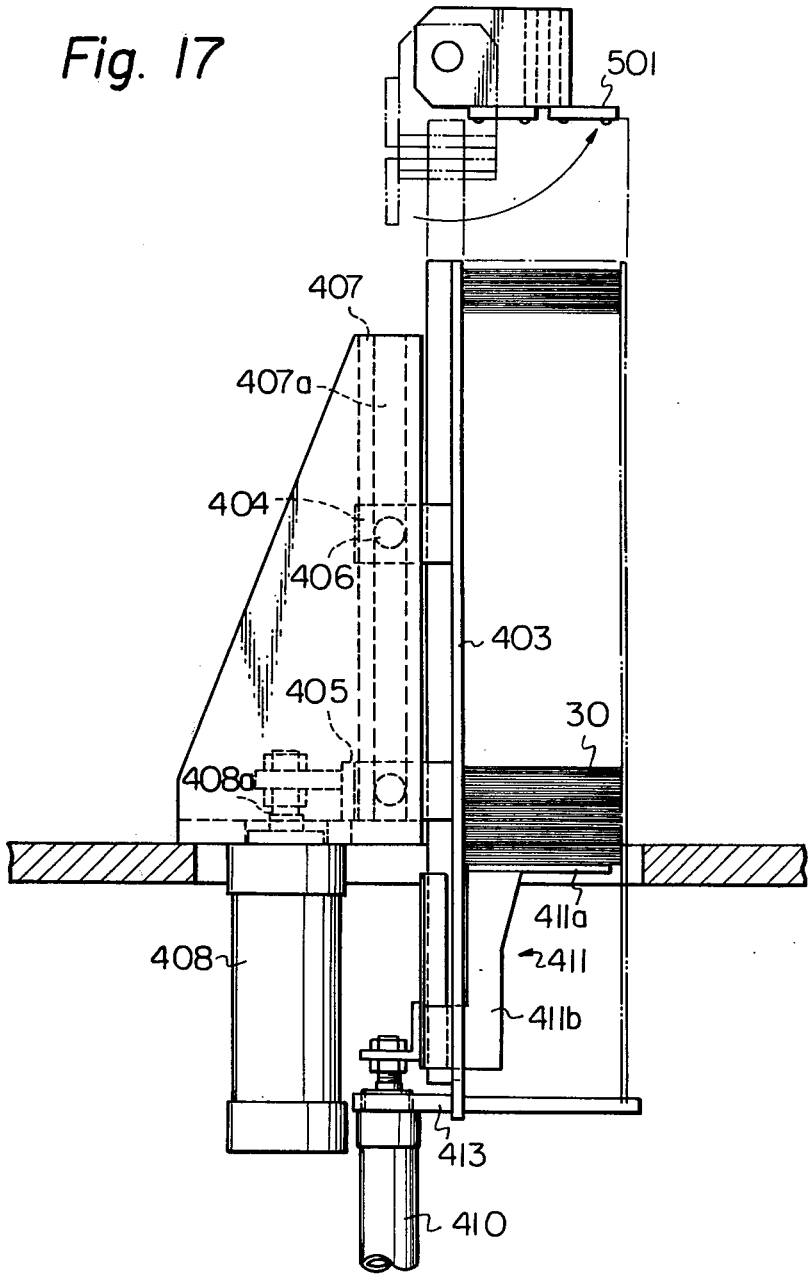
FIG. 17 is a side view of the gore supply member illustrated in FIG. 15.
Figure 18:
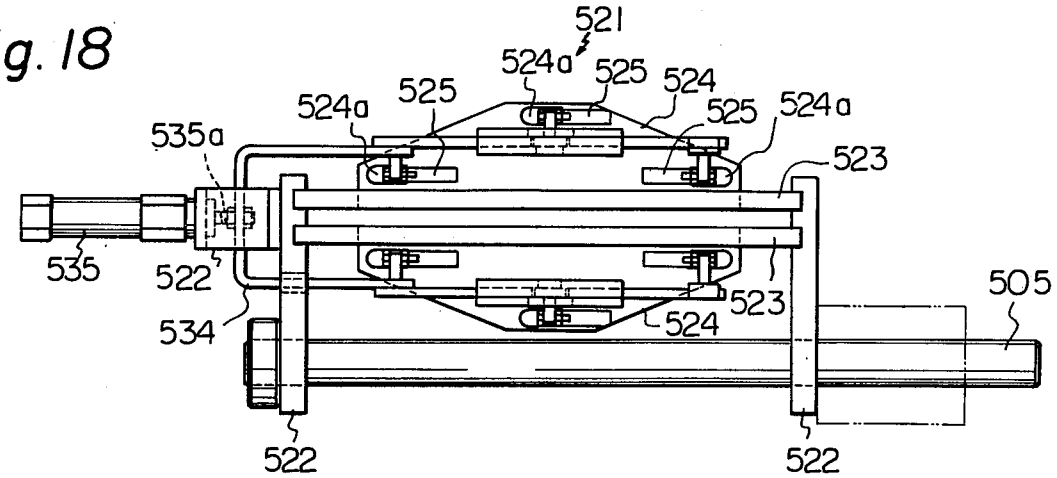
FIG. 18 is an elevational view of a grasping head of the grasping member.
Figure 19:
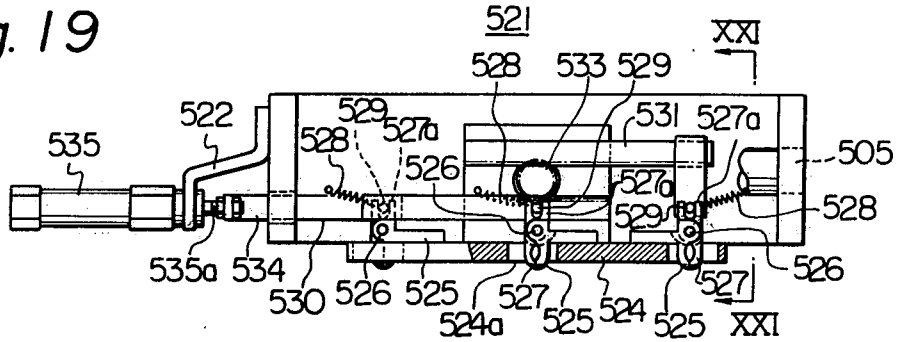
FIG. 19 is a cross sectional plan view of the grasping head.

Referring to FIG. 15, the gore supply member 401 includes a hopper 403, which accommodates a plurality of gore materials 30 preshaped in a diamond shape and which lifts the gore materials 30 after the grasping member 501 has been positioned at the upper portion of the hopper 403, as will be explained later. As a result, the gore materials 30 are urged toward the grasping member 501 and are compressed so as to facilitate the grasping by the grasping member 501. Referring to FIG. 17, brackets 404 and 405 fastened to the hopper 403 are mounted via bearing rollers 406 on a stationary bracket 407 so as to be slidable along vertical guide grooves 407*a* formed on the bracket 407. The bracket 405 is connected to a piston rod 408*a* of a stationary pneumatic lift cylinder 408 so that the hopper can be lifted and lowered by the actuation of the pneumatic cylinder 408. The hopper 403 has a pneumatic compression cylinder 410 mounted thereon via bracket 413, a piston rod 410*a* of which is connected to a compression head 411. The compression head 411 comprises a pair of plates 411*a* for receiving gore materials 30 thereon and a pair of supports 411*b* which are connected to the plate 411*a*. Since ball bearings 413 are mounted between the supports 411*b* and a guide 412 (FIG. 15) disposed on the hopper 403, the plates 411*a* are slidable along a pair of slots (not shown) formed on the hopper 403. When the pneumatic compression cylinder 410, which has been lifted with the hopper 403, is actuated, the compression head 411 is lifted and compresses the gore materials 30 mounted thereon toward the grasping member 501.

Figure 16:
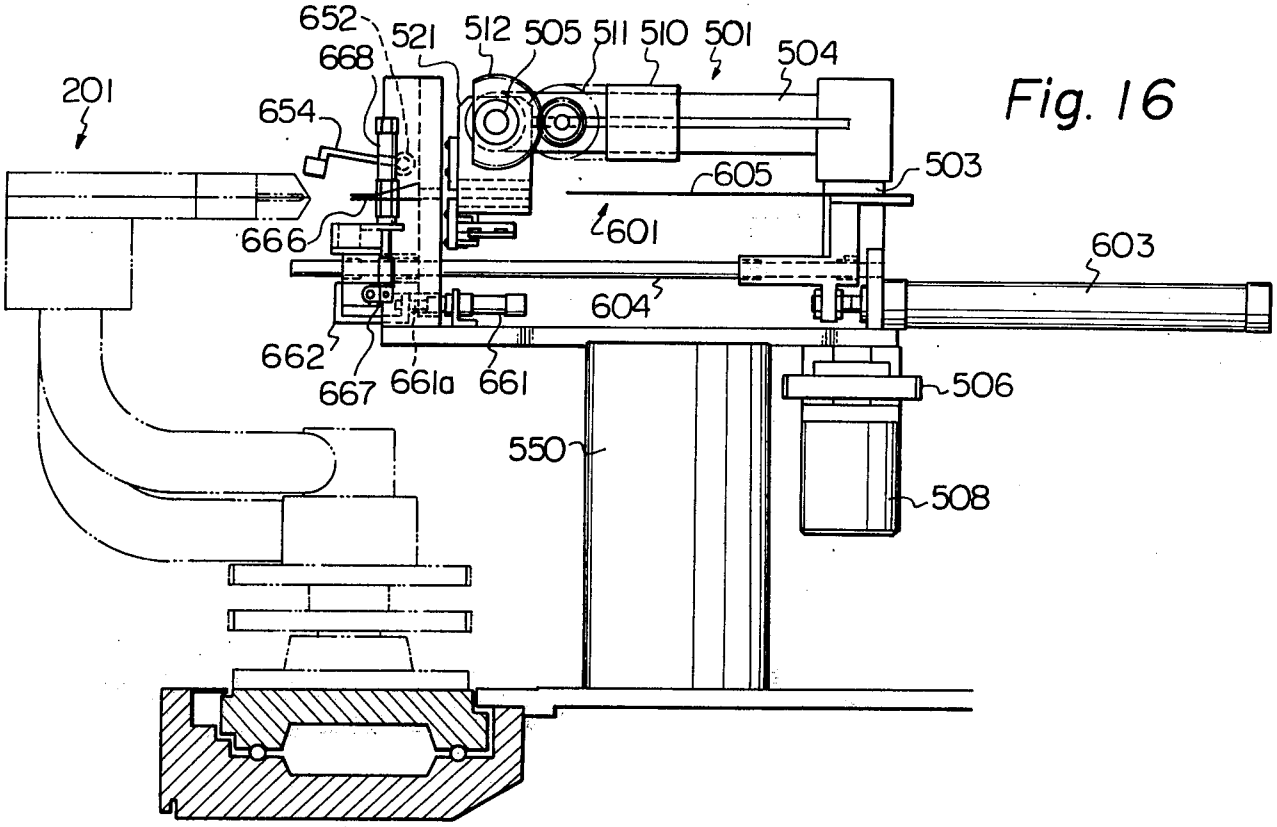
FIG. 16 is an elevational view of the members illustrated in FIG. 15.

Referring to FIG. 15 again, the gore grasping member 501 is movable between a first position in front of the template unit 201 positioned at the station IV and a second position above the hopper 403 of the gore supply member 401, and the gore grasping member 501 grasps the gore material 30 positioned horizontally at the second position and positions the gore material 30 vertically at the first position. In FIGS. 15 and 16, a vertical swing shaft 503 which is rotatably pivoted on a frame 550 has an arm 504 fixedly connected thereto. The arm 504 has a horizontal swing shaft 505 rotatably mounted thereon at the front end thereof. The swing shaft 505 has the grasping member 521 fixedly mounted thereon. The lower end of the vertical swing shaft 503 has a large gear 506 fixedly connected thereto which meshes with a small gear 507 (FIG. 15) connected to a rotating shaft (not shown) of a motor 508 (FIG. 16) which is fixedly disposed on the frame 550. The arm 504 and the grasping head 521 is swung around the vertical swing shaft 503 due to the rotation of the motor 508.

The arm 504 has a pneumatic rotary cylinder 510 fixedly mounted thereon which has a gear 511 for meshing with a gear 512 having a shape of an one half of circle. The gear 512 is connected to the horizontal swing shaft 505. Due to the rotation of the pneumatic rotary cylinder 510, the horizontal swing shaft 505 is swung so that the grasping head 521 can be located at a first position illustrated in FIGS. 15 and 16 and a second position perpendicular to the first position.

Figure 20:
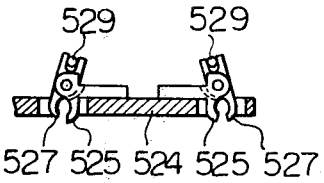
FIG. 20 is a partial plan view which is used to explain the operation of fingers mounted on the grasping head.
Figure 21:
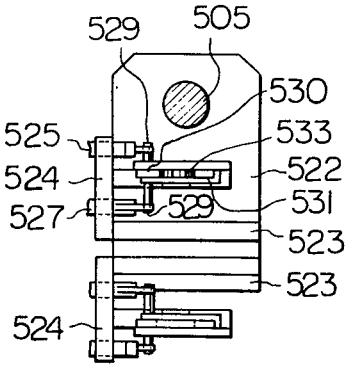
FIG. 21 is a view taken along line XXI—XXI in FIG. 19.

Referring to FIGS. 18 through 21, the grasping head 521 will now be explained. The horizontal swing shaft 505 has a pair of opposite brackets 522 fixedly mounted thereon. A pair of horizontal members 523 are disposed between the brackets 522 having a vertical distance therebetween. The upper horizontal member 523 has an upward triangular plate 524 and the lower horizontal member 523 has a downward triangular plate 524. Each of the plates 524 has three horizontally elongated holes 524*a* formed at positions near the vertexes of the triangle. Stationary fingers 525 formed in a crescent shape are fastened to the rear side of the plate 524 and project through the elongated holes 524*a*, and have movable fingers 527 swingably pivoted thereon via pins 526. The rear end of each movable fingers 527 is forked (see FIG. 19). The movable finger 527 is urged by a spring 528 connected to the plate 524 and is closed to the stationary finger 525 at the top thereof. Pins 529 fixed to horizontally extending rack members 530 and 531 engage with the forked portion of the movable fingers 527. The rack members 530 and 531 mesh with a pinion rotatably mounted on the plate 524. The rack members 530 are connected via a C-shaped connecting member to a piston rod 535*a* of a pneumatic cylinder 535 connected to a bracket 522. When the cylinder 535 is actuated and the piston rod 535*a* is advanced, the two left movable fingers 527 illustrated in FIG. 19 swing clockwisely and the right movable finger swings counterclockwisely, and they open as illustrated in FIG. 20. The gore material 30 is compressed between the stationary fingers 525 and the movable fingers 527. Then the cylinder 535 is moved backward, and the stationary and movable fingers 525 and 527 are closed so as to grasp the gore material 30.

Referring FIGS. 15 and 16 again, the frame 550 (FIG. 16) has the gore insert member 601 which includes an insert plate 605. The plate 605 has a fan shape and small needles 605*a* for holding the gore material disposed at the front of the fan shaped plate 605, and is connected to an insert pneumatic cylinder 603 so that the insert plate 605 can horizontally move along a pair of horizontal guides 604 which are fixed to the frame 550. After the gore grasping member 501 has grasped the gore material 30 and is positioned vertically in front of the template unit 201 positioned at the station IV, due to the actuation of the instant pneumatic cylinder 603, the insert plate 605 urges the gore material 30 along a diagonal of the diamond through the horizontal clearance between the horizontal members 523 (FIG. 18) of the grasping head 521 and folds the gore material 30 in two. Then, the folded gore material 30 is inserted into the stocking materials which are held by the template unit 201.

The front end of the frame 550 has a folding guide member as shown in FIG. 15 and 16, by which the lower flap of the folded gore and the cut flaps of the lower stocking material are folded and are grasped by the above-mentioned lower portion of the template unit 201. The frame 550 has a pair of brackets 651 fixedly mounted thereon each of which has a swing shaft 652 swingably pivoted therebetween. The end of the swing shaft 652 is connected to an electric rotary solenoid 653 (FIG. 15) which is fixed to the frame 550. A pair of L-shaped pressing devices 654 are fixed to the swing shaft 652, and have heads of non-abrasive and a high coefficient of friction material. When the rotary solenoid 653 is actuated, the pressing devices 654 press the flaps of the upper stocking material to the surface of the insert plate 605, so that the flaps are prepared for the subsequent seaming operation.

The frame 550 has a pneumatic advance cylinder 661 fixedly mounted thereon, a piston rod 661*a* of which is connected to an advancing member 662 of a lower plate spring 666 which is slidably mounted on the front end of the horizontal guides 604. The advancing member 662 of the lower plate spring 666 has a pair of brackets 663 having a C-shape disposed in a V-formation so that they correspond the disposition of the templates at the station IV. Each of the brackets 663 has a small swing shaft 664 swingably mounted therebetween. The small swing shafts 664 are connected to each other via a universal joint 665 (FIG. 15) and have plate springs 666 connected thereto via arms (not shown) for pressing the lower gore flap and the cut flaps of the lower stocking. One of the small swing shafts 664 in FIG. 15 is fixed to a lever 667 which is actuated by means of a small pneumatic cylinder 668 connected to the advancing member 662. After the insert plate 605 is inserted, the lower plate spring 666 is advanced toward the lower gore flap and the cut flaps of the lower stocking material, and then, due to the actuation of the small pneumatic cylinder 668, the lower gore flap and the cut flaps of the lower stocking are swung along a circular passage with the lower plate spring 666, open the flap 279 of the lower template 277 of the template unit 201 and are grasped by the flap 279.

First Sewing Machine

Figure 22A:
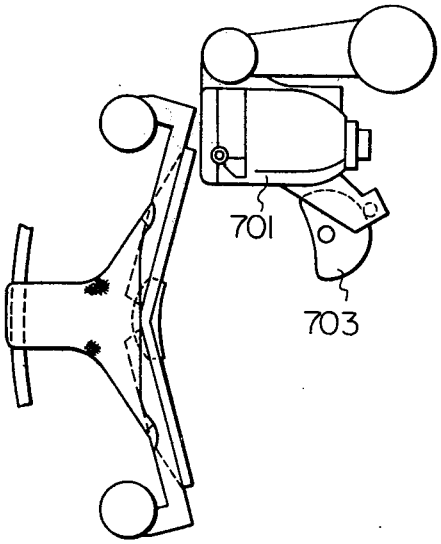
FIGS. 22A and 22B are plan views of a first sewing machine.
Figure 22B:
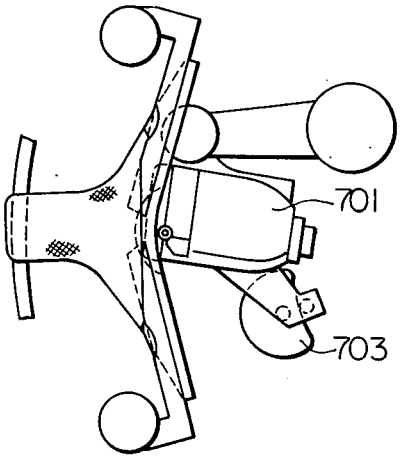

After the lower gore flap 30 (FIG. 15) and the cut flaps of the lower stocking material are grasped by the flap 279 of the template unit 201, they are sewn by means of a first sewing machine 701. In this embodiment, only the gore flap portion is sewn by the first sewing machine so as to facilitate the operation of the seaming machine. As illustrated in FIGS. 22A and 22B, the first sewing machine 701 is swung by means of a cam member 703.

Folding Device

Figure 23:
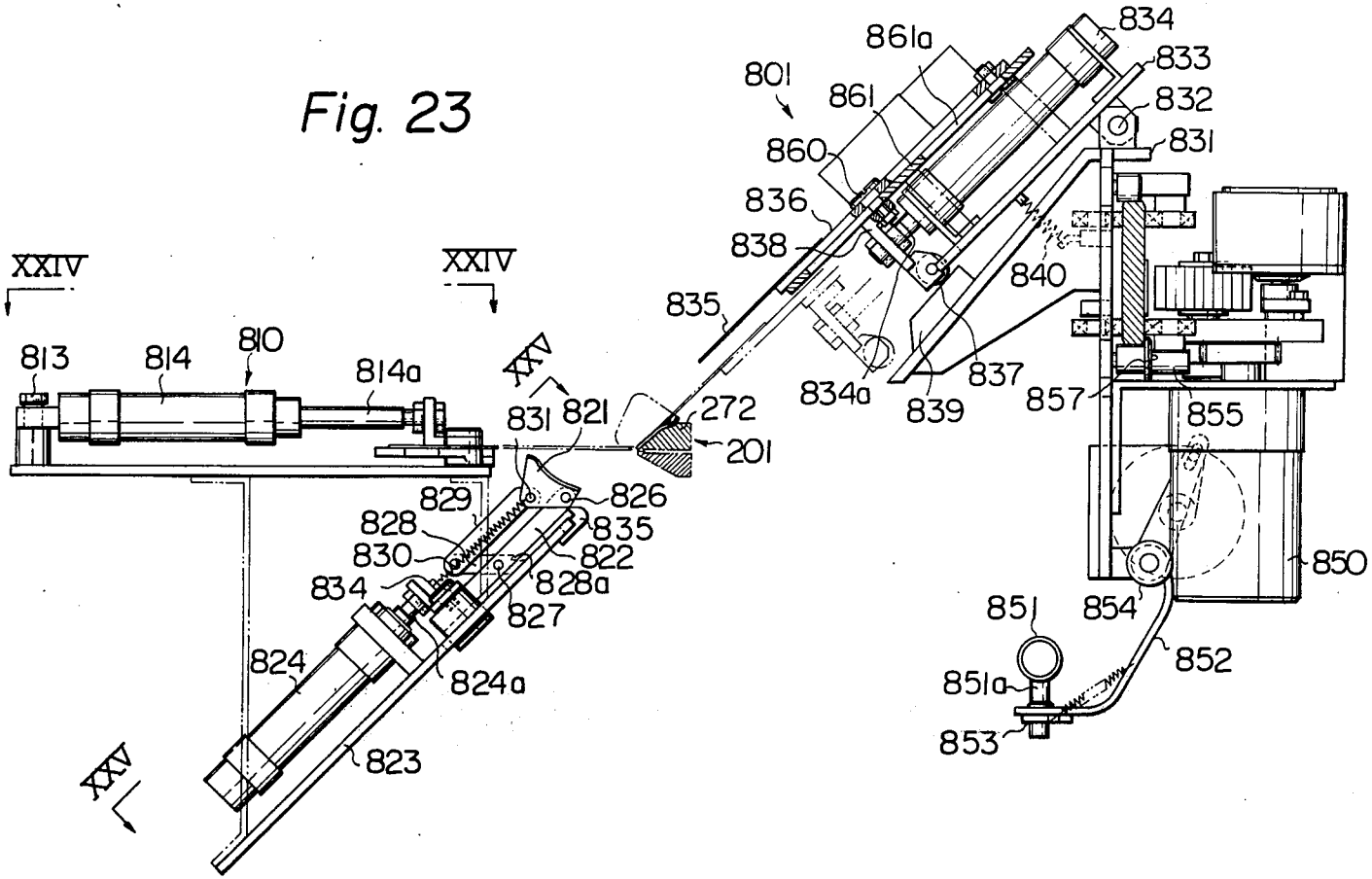
FIG. 23 is a side view of a folding device.
Figure 24:
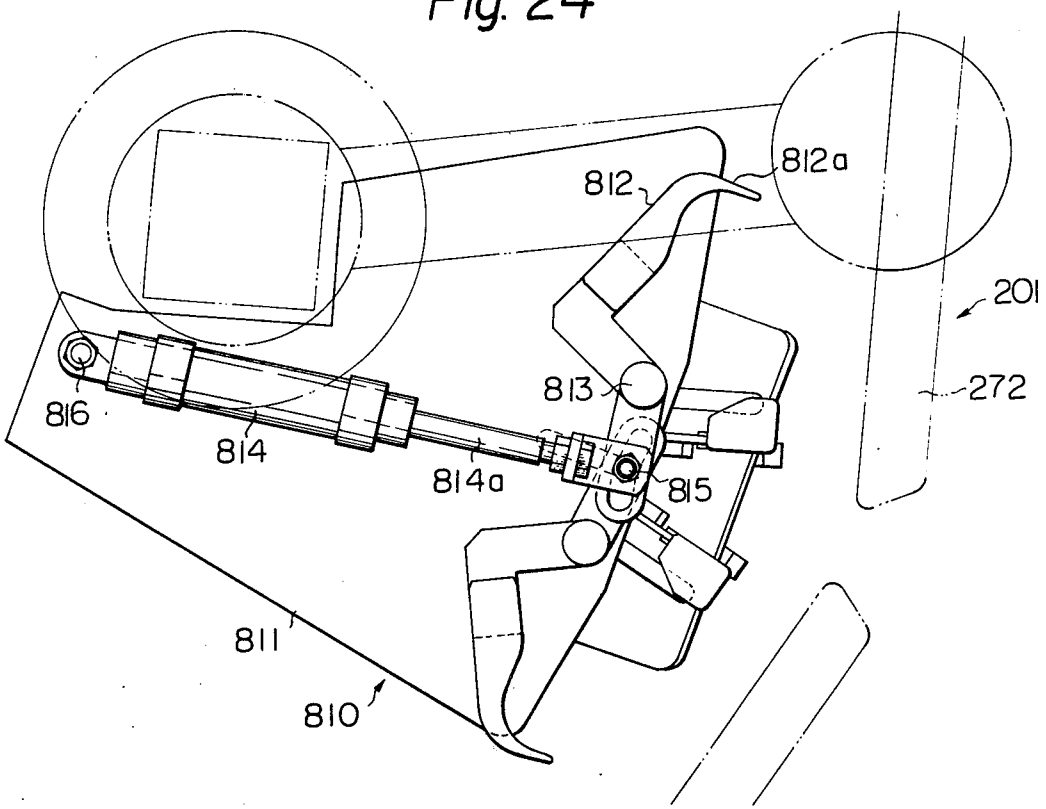
FIG. 24 is a view taken along line XXIV in FIG. 24.

As mentioned above, the folding device 801 is disposed at the station VI for folding the seamed cut flaps of the upper stocking material and upper gore flap upward and for securing them on the outer surface of the upper templates 272. In FIG. 23, a folding guide member 810, which is used for folding the stocking materials and prevents the stocking materials from rolling, is disposed at a central position of the station VI with respect to the guide rail 106 (FIG. 4). The folding guide member 810 has a pair of L-shaped fingers 812 (FIG. 24) swingably pivoted via pins 813, the ends of which fingers are formed in a crescent shape and which guide the stocking materials when they are folded as will be explained later, swingably mounted on a plate 811. The plate 811 fixed to the guide rail 106 (FIG. 4). The rear ends of the L-shaped fingers 812 are pivoted to a piston rod 814*a* of a pneumatic cylinder 814 via a pin 815, which cylinder is pivotably mounted on the plate 811 via a pin 816. Due to the actuation of the pneumatic cylinder 814, the L-shaped fingers are swung.

Figure 25:
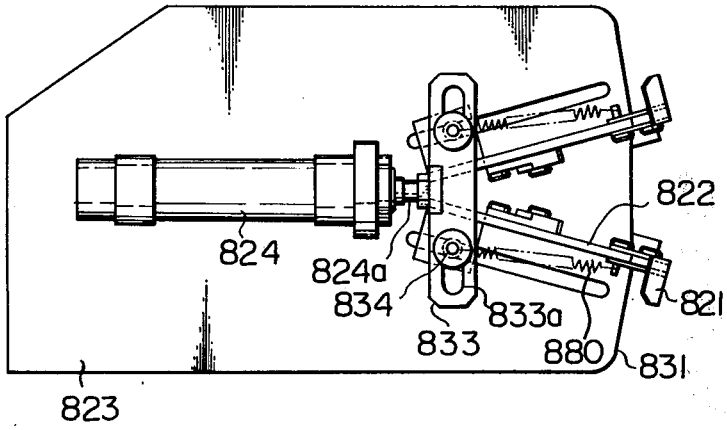
FIG. 25 is a view taken along line XXV in FIG. 23.

After the L-shape fingers are positioned in front of the upper templates 272, the seamed upper gore flap and cut flaps of the upper stocking material are folded by means of folding members 821 which are swingably pivoted to ends of a stem 822 via pins 826. The stem 822 has a V-shape (see (FIG. 25) and is perpendicular to the upper templates. The stem 822 is connected to an end of a piston rod 824*a* of a pneumatic cylinder 824 which is fixedly mounted on a plate 823 fixedly disposed on an internal frame 802 (see FIG. 4). The V-shaped stem 822 has arms 828 swingably pivoted thereon via pins 827, the folding members 821 swingably pivoted thereon via pins 826, and levers 829 pivotably connected to the arms 828 and the folding members 821 so that a pair of parallel crank mechanisms are constructed (see FIG. 23). Tension spring 830 are disposed between the pins 831 and pins 834, which engage with elongated holes 833*a* formed on a plate 833 which is fixedly connected to the piston rod 824*a*, so that the folding members 821 are urged backward. The lower ends of the arms 828 have notches 828*a* formed thereon which engage with hooks 835 disposed at the front ends of the plates 823. Due to the engagement of the notches 828*a* and hooks 835 the arms 828 are swung around the pins 827 in a clockwise direction and the folding members 821 are also swung in the same direction. When the piston rod 814*a* is advanced by means of actuation of the cylinder 814, the folding members 821 are advanced in a condition illustrated by a solid line in FIG. 23, and lift up the seamed upper gore flap and cut flaps of the upper stocking material. When the notches 828*a* of the arms 828 engage with the hooks 835, the folding members 821 are tilted as illustrated by a dot-dash line in FIG. 23, and fold the upper gore flap and the cut flaps of the upper stocking material upward.

Referring to FIG. 23, a movable frame 861 has a swing plate 836 vertically and swingably pivoted thereon via a pin 832, which plate 836 is connected to a pneumatic cylinder 834. A piston rod 834*a* of the pneumatic cylinder 834 has a bracket 838 fixedly mounted thereon which has a cam follower 838 at the bottom end thereof and which has a slide plate 836 horizontally and swingably pivoted thereon via pin 860. The slide plate 836 has securing members 835 fixedly mounted thereon. Due to the actuation of the cylinder 834, the securing members 838 are horizontally swung while the securing members 838 are advanced. The cam follower 837 is in contact with a cam 839 formed in a trapezoid and fixed to the movable frame 839. When the cylinder 834 is actuated and the piston rod 834*a* is advanced, the securing member 835 reaches a position above the upper template 272 of the template unit 201 in a condition illustrated by a solid line in FIG. 23. When the piston rod 834*a* is further advanced, the cam follower 837 is disengaged from the cam surface 839 and the securing member 835 is urged toward the upper templates 272 by means of a spring 840 as illustrated by a dot-dash line in the figure.

The movable frame 831 has a hook 853 which is pivotably mounted on a bracket 852 and which engages with a pin 851*a* projecting on an arm 851. The arm 851 moves with the carrier 107 so that the movable frame 831 can move with the carrier 107. When the movable frame 831 reaches a predetermined position, the bracket is swung around a pin 854 and the hook 853 is disengaged from the pin 851*a*. Then the movable frame 831 is returned to the original position along a guide rail 851 disposed along the guide rail 106 by means of a motor 850 fixedly mounted on the frame 831 and a friction wheel 855 driven by a drive shaft of the motor 850.

Second Sewing Machine

Since the construction of the second sewing machine is similar to that of the first sewing machine, its explanation is omitted.

Operation of the First Embodiment

Figure 26A:
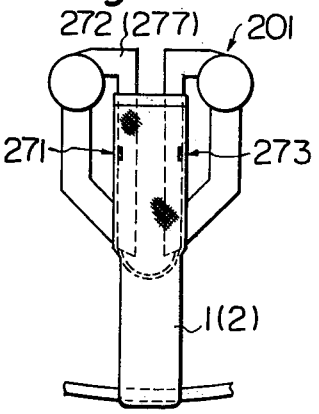
Figure 26B:
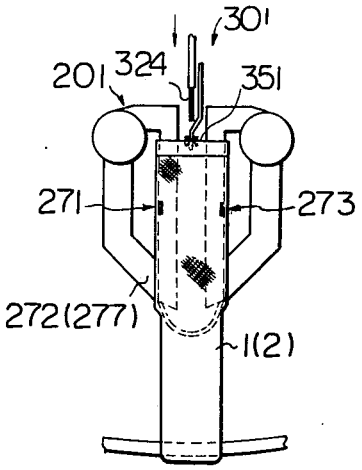
Figure 26C:
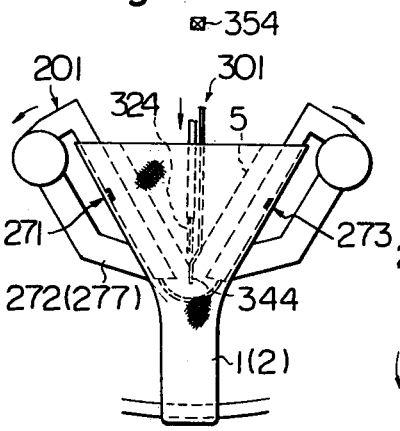
Figure 26D:
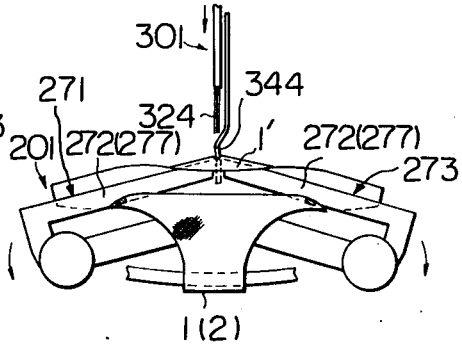
Figure 26D:
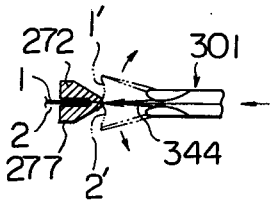
Figure 26:
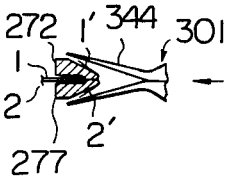
Figure 26:
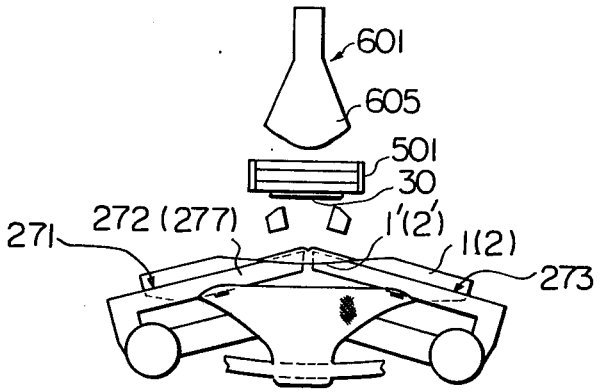
Figure 26:
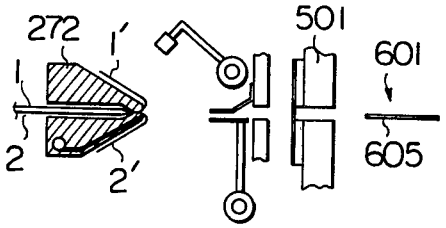
Figure 26:
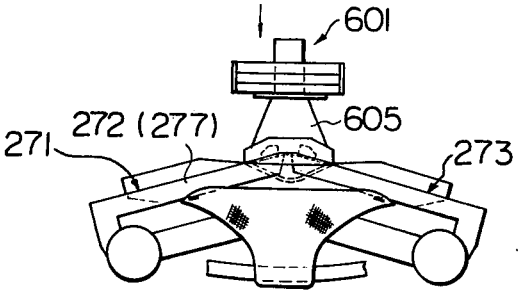
Figure 26:
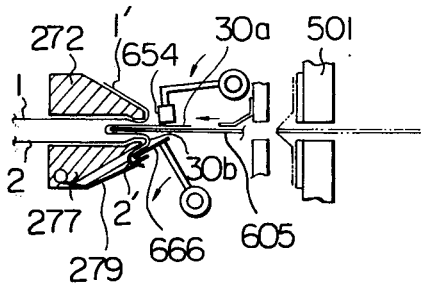
Figure 26:
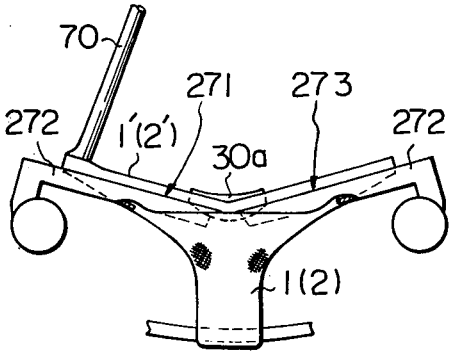
Figure 26:
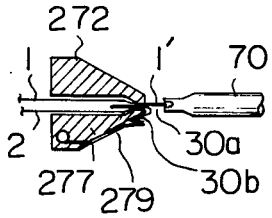
Figure 26L:
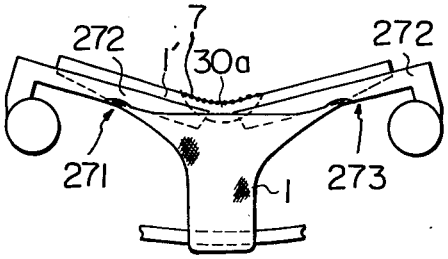
Figure 26M:
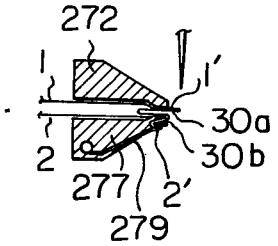
Figure 26N:
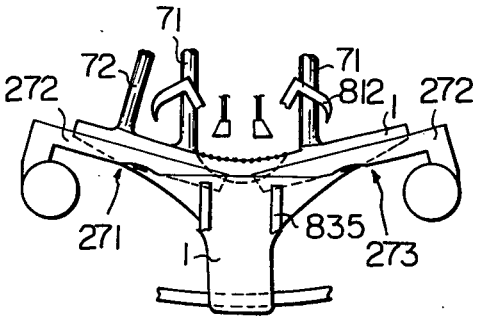
Figure 26O:
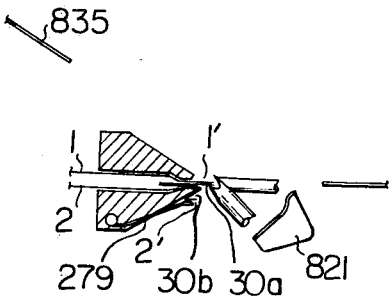
Figure 26P:
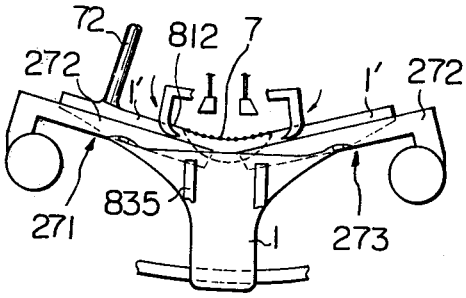
Figure 26Q:
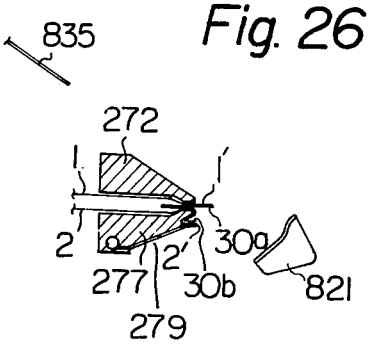
Figure 26R:
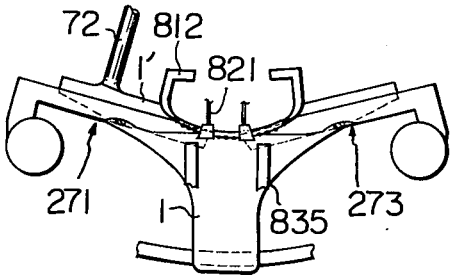
Figure 26S:
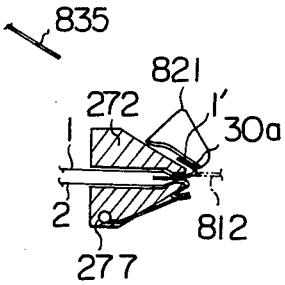
Figure 26T:
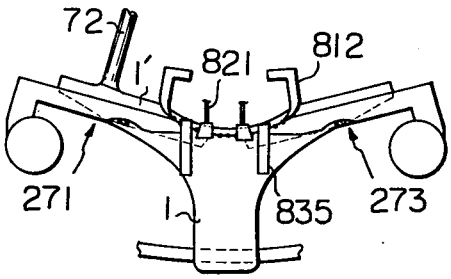
Figure 26U:
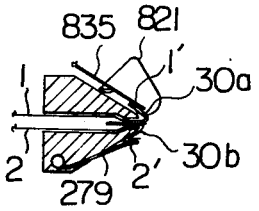
Figure 26V:
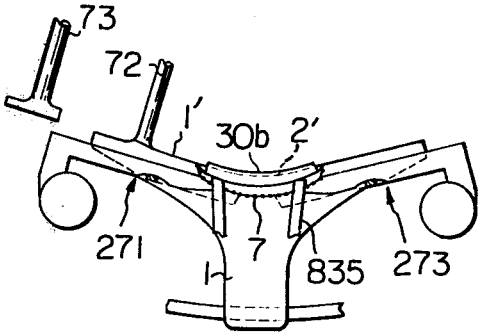
Figure 26W:
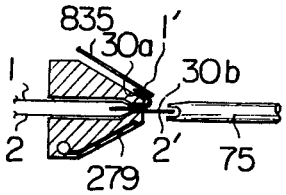
Figure 26X:
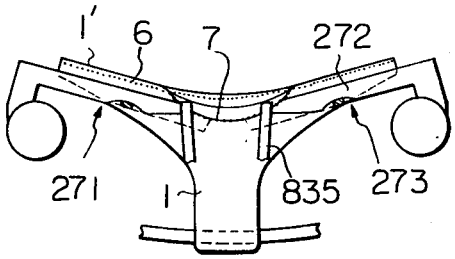
Figure 26Z:
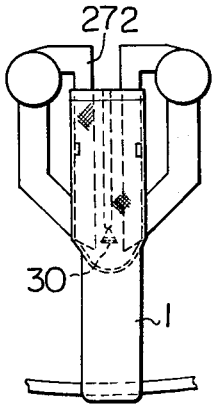

Referring to FIGS. 4 and 26A through 26Z, the operation of the above mentioned embodiment will now be explained.

At the station I illustrated in FIG. 4, an operator manually supplies a pair of stocking materials 1 and 2 to a pair of template assemblies 271 and 273, i.e., a pair of upper templates 272 and lower templates 277 of the template unit 201 (FIG. 26A). The template unit 201, having stocking materials mounted thereon, is moved with the carrier 107 to the station II illustrated in FIG. 4, where the cutter blades 324 of the cutter device 301 are moved forward to the stocking materials 1 and 2. While the template unit 201 moves from the station II to the station III, the cutter device 301 is moved in synchronism with the template unit 201. After the stocking materials 1 and 2 has been detected by means of a reflection type photoelectric detecting device 351 (FIG. 26B), the slicing operation is effected. The cutter blades 324 slice the stocking materials 1 and 2 along a line 5 illustrated in FIG. 2, and the template assemblies 271 and 273 of the template unit 201 are spread out. Then, the cut flaps of the stocking materials positioned at the thigh portions of the stocking materials are open outward (FIGS. 26D through 26E$_2$).

Before the template unit 201 reaches the station III, the cutter device 301 is disengaged from the template unit 201 and is returned to the station II.

Before the template unit 201 reaches the station III, the template assemblies 271 and 273 are spread out to a reverse V-shape condition so that the thigh portions of the stocking materials are exposed in a triangular shape. When the template 201 is positioned at station III, the rolling of the stocking materials is checked by means of a photoelectric detecting device 60 (FIG. 4).

At the station IV, a diamond shaped gore material 30, which is folded in two, is inserted into a clearance between the upper and lower stocking materials 1 and 2. This operation is effected as follows. The gore material 30 is vertically positioned in front of the template assemblies 271 and 273 by means of the grasping member 501 (FIG. 26F and 26G). In this case, diagonal line of the diamond shaped gore material 30 along which line the material is folded in two is horizontal and is aligned with the center of the templates 272 and 277. Then, the insert plate 605 of the insert member 601 is advanced so that the gore material 30 is folded in two and is inserted between the cut edges 1' and 2' (see FIG. 2) of the stocking materials held by the template assemblies 271 and 273 (FIGS. 26H and 26I). Since the tips of the templates 272 and 277 where the gore material 30 is inserted are scraped as mentioned above, the inserting operation can easily be effected. While the gore material 30 is inserted between the cut flaps 1' and 2' (FIG. 2) of the stocking materials, the upper flap of the stocking material is pressed by means of the pressing device 654 (FIG. 26I). After the gore material 30 is inserted, the lower gore flap 30*b* and the cut flap 2' of the lower stocking material 2 are pressed into the flap 279 of the lower template 277 by means of the lower plate spring 666 and are grasped by the flap 279. (It should be noted that the distance between the upper and the lower templates 272 and 277 illustrated in FIG. 26I is increased so as to facilitate understanding.)

While the template unit 201 is advanced from the station IV to the station V, the template assemblies 271 and 273 are returned to a substantially straight condition. Between the station V and the station VI, the cut flaps 1' and 2' of the stocking materials are sucked and tensed by means of a suction tube 70 (FIGS. 26J and 26K) so that the cut flaps 1' and 2' and the upper gore flap 30*a* are made uniform as illustrated in FIG. 26K. The upper gore flap 30*a* and the cut flaps 1' of the upper stocking material 1 are seamed along a line 7 illustrated in FIG. 2E by means of the first sewing machine 701 (FIG. 4) and the remainder of the flaps are cut off (FIGS. 26L and 26M).

When the template unit 201 reaches the station VI, the seamed upper gore flap 30*a* and cut flaps 1' of the upper stocking material are sucked by means of sucking tubes 71 (FIGS. 26N and 26O), the fingers 812 are turned to a position in front of the upper templates 272, and above the gore flap 30*a* and the cut flaps 1' of the upper stocking material (FIGS. 26P and 26Q). Then, after the seamed gore flap 30*a* and cut flaps 1' of the upper stocking material 1 are folded onto the upper surface of the upper templates 272 by means of the folding members 821 (FIGS. 26R and 26S), the folded flaps are secured by means of the securing members 835 (FIGS. 26T and 26U).

Figure 26Y:
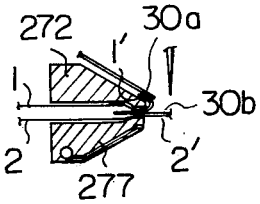

The template unit 201, the upper surfaces of the upper templates 272 thereof being pressed by means of the securing members 835, is moved from the station VI to the station VII. During this movement the lower gore flap 30*b* and the cut flaps 2' of the lower stocking material 1 released from the flap 279 are disposed at the lower portions of the lower templates 277 and are sucked by means of a suction tube 72 (FIGS. 26V and 26W) are tensed. After the released flaps are sucked and tensed by another sucking tube 73, the released flaps and the cut flaps of the upper and lower stocking materials are seamed together along a line 6, illustrated in FIG. 2D, by means of the second sewing machine 901 (FIG. 4), and the remainders of the flaps are cut off (FIGS. 26X and 26Y).

Before the template unit reaches the station VII, the securing members 835 are released from the template unit 201.

At the station VIII, the template assemblies 271 and 273 return to the original position thereof and the finished gored panty-hose is taken up from the template unit 201 by means of an automatic taking up mechanism (not shown) (FIG. 26Z).

Second Embodiment

Another embodiment of the method according to the present invention will now be explained with reference to the accompanying FIGS. 27 and 28A through 28J. The stocking material mounting operation is effected by an operator at the station I. A carrier 107 travels in a direction designated by arrow a. At the station II a cutter device 301' is actuated, so that the cutter blades 324' are advanced between horizontally spaced template assemblies, and the central portion of stocking materials held by the template assemblies are sliced. The cutter device 301' has a construction similar to that explained with reference to FIG. 11 so that scissors type cutters 324' are reciprocated horizontally and that the cutters can cut the materials due to the swinging operation thereof. After the materials are cut, the template assemblies which hold the materials effect the first spreading out operation between the station II and III, so that the template assemblies are spread out to condition beyond a circular passage and the cut flaps are exposed outward. Since the template assemblies are spread out to a condition beyond a circular passage and since the cut flaps are exposed outward, the template assemblies form a reverse V-shape having a vertex at the free ends thereof. As a result, the cut flaps 1' and 2' positioned at the vertex are vertically separated as illustrated in FIG. 28A.

Figure 27:
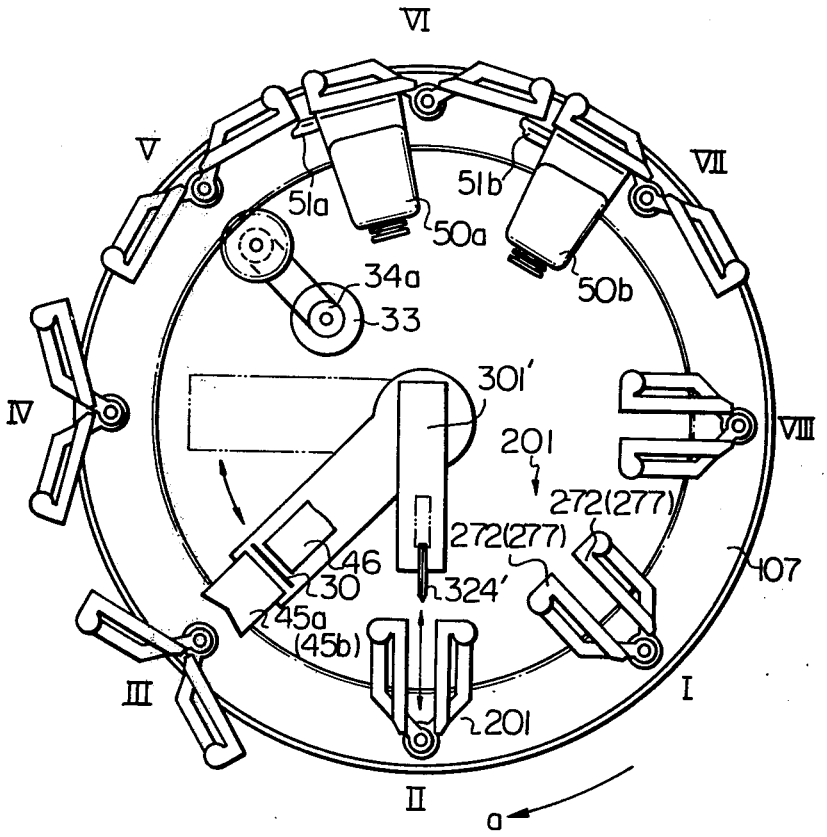
FIG. 27 is a plan view which is used to explain the method of the second embodiment according to the present invention.
Figure 28A:
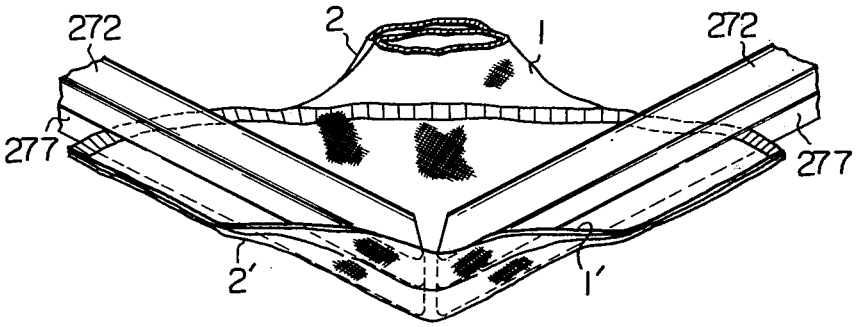
Figure 28B:
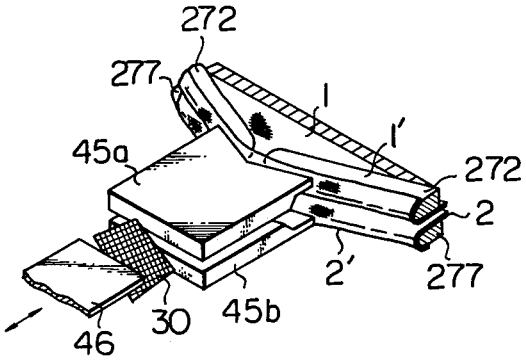
Figure 28C:
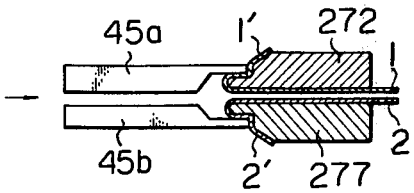
Figure 28:
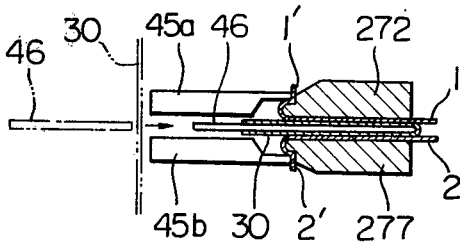
Figure 28:
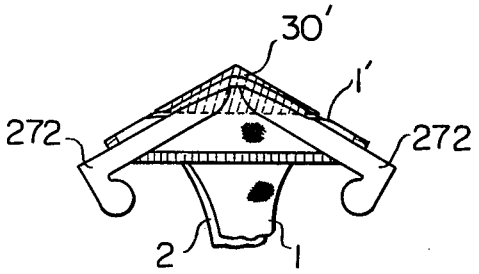
Figure 28:
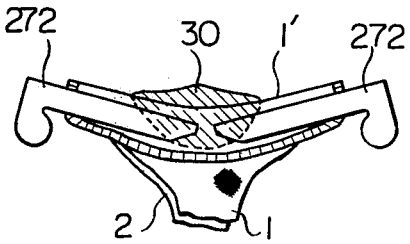
Figure 28G:
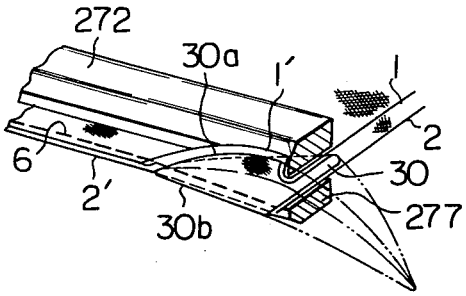
Figure 28H:
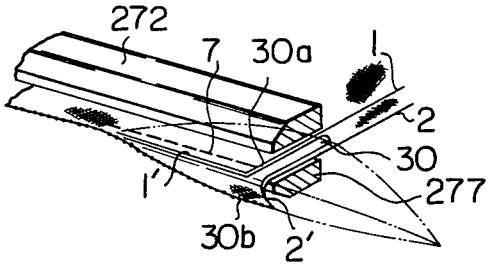
Figure 28I:
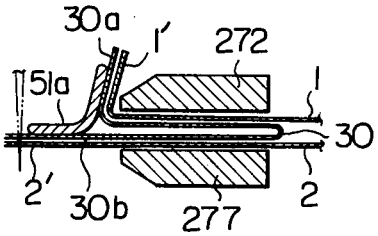
Figure 28J:
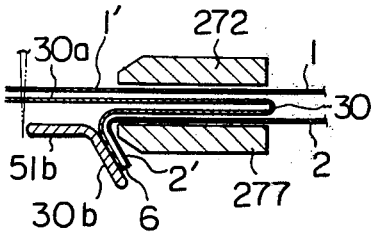

While the template assemblies are moved from the position III to the position IV illustrated in FIG. 27, a diamond shaped gore which is folded in two is inserted between the vertically separated cut flaps. In this embodiment, when the gore material is inserted, a pair of upper and lower plates 45*a* and 45*b* are pressed to the free ends of the template assemblies which hold the separated and spread flaps. In other words, the plate 45*a* is pressed to the upper templates and the plate 45*b* is simultaneously pressed to the lower templates, so that the spread out flaps are held between the plate and the side of the template and a small clearance is formed between the templates which has been vertically nipped together as illustrated in FIG. 28C. A gore material 30 having a diamond shape is guided and inserted between the clearance so that the gore material is folded in two and inserted into the stocking materials. During this insertion, since the spread out materials 1' and 2' are held between the plate and the sides of the templates, they do not displace. After the insert plate 46 has inserted the gore material 30 as illustrated in FIG. 28E, the plate 45*a* and 45*b*, which have been pressed to the templates, are moved backward with the insert plate and return to the original position. Then, the templates recover the complete nipping condition and the inserted gore material 30, which is folded in two and which is forming a triangular shape, is held. While the template assemblies are moved from the station IV to the station V, the template assemblies 271 and 273, which have been positioned in a reverse V-shape as illustrated in FIG. 28E are returned to a position along a circular passage as illustrated in FIG. 28F. Since the template assemblies are returned to a position along a circular passage, the gore material, which has been formed in triangular shape, the bottom side of the triangular shape is drawn as illustrated in FIG. 28E and the vertex portion 30' of the triangular shape is contracted to a straight line so that a bag shape is formed, as illustrated in FIG. 28F. The template assemblies positioned along a circular passage are advanced from the station V to the station VI in FIG. 27. The cut flaps of the stocking material and the gore flap, which are positioned along a circular passage, are seamed along a line 6 illustrated in FIG. 2D while they pass through a sewing machine 50*a*. Then, at the station VII, when the template assemblies pass through a sewing machine 50*b*, the remaining cut flaps and the remaining gore flap are seamed along a line 7 illustrated in FIG. 2E. A guide plate 51*a* for vertically separating gore flaps before they pass the sewing machine 50*a* is disposed upstream and in front of the sewing machine 50*a*. As a result, the upper gore flap 30*a* of the folded and inserted gore material is folded upward with upper cut flaps 1' of the stocking material, as illustrated in FIG. 28G and 28I, so that they do not disturb the sewing operation of the sewing machine 50*a*. The sewing machine sews along a seam line 6 illustrated in FIG. 28G (in other words, line 6 in FIG. 2D) and the lower gore flap 30*b* is seamed with the cut flaps 2' of the lower stocking materials 2.

After the seam line 6 is formed by the sewing machine 50*a*, the remaining positions, i.e., the upper gore flap 30*a* and a part of the cut flaps of the upper stocking material, are seamed by means of a sewing machine 50b. A guide plate 51b for vertically separating gore flaps is disposed upstream of the sewing machine 50b. The guide plate 51b folds the seamed materials downward as illustrated in FIG. 26J, so that they do not disturb the sewing operation of the sewing machine 50b. As a result, the sewing machine 50b sews the upper gore flap 30a and a part of the cut flaps of the upper stocking material along a seam line 7 illustrated in FIG. 28H (line 7 in FIG. 2E).

After the two stepped seaming operation by means of the sewing machines 50a and 50b is completed, the template assemblies 271 and 273 are returned to their original positions where they are parallel with each other from their positions along the circular passage while they move from the station VII to the station VIII. Then, the clamping of the materials are released and the the finished panty-hose is taken up at the station VIII. The templates which are vertically separated from each other are returned to the station I where a new pair of stocking materials is mounted on the templates. Then, the new stocking materials are sewn in accordance with the seaming method mentioned above.

What we claim is:

1. A method of seaming panty-hose having gores of a diamond shape, which method comprises following steps a through e in sequence:

step a in which, after a pair of stocking materials formed in a cylindrical shape is held so as to align the sides of said stocking materials with each other, the overlapped central portions of said stocking materials are cut from one end to the thigh portion of said stocking materials to form cut edges with cut flaps;

step b in which the cut edges of said stocking materials are spread out until said cut edges are aligned in a reverse V-shape condition while said cut edges are held and the cut flaps of said stocking materials at said cut edges are vertically separated from each other;

step c in which, after a folded gore which has a diamond shape is provided and inserted into a clearance formed between said separated cut flaps, said folded gore is held with said stocking materials, and a first pair of a gore flap and the cut flaps of one of said stocking materials is folded outward, and the held gore edges and the held edges of said stocking materials are aligned in a substantially straight line condition;

step d in which a second pair of a gore flap and cut flaps of the other stocking material is seamed by means of a first sewing machine while said gore and stocking materials are held, and;

step e in which said seamed second pair of gore flap and flaps of the other stocking materials is folded outward, and said first pair of the gore flap and the flaps of said first stocking material is seamed by means of a second sewing machine while said gore and stocking materials are held.

2. A method of seaming panty-hose having gores of a diamond shape according to claim 1, including the step in which the corresponding parts of the hip portions of said stocking materials are held together at two adjacent areas the shapes of which areas are rectangular and substantially parallel to one another and the locations of which areas are slightly spaced from one another to define a narrow elongated nip therebetween, the cutting line along which said cutting is effected extending along said nip.

3. A method of seaming panty-hose having gores of a diamond shape according to claim 1, wherein said step for cutting said stocking materials further comprises a step for opening the front portions of said cut flaps of said stocking materials and a step for folding said open front portions outward until said front portions reaches the outer surface of template assemblies which hold said stocking materials.

4. A method of seaming panty-hose having gores of a diamond shape according to claim 1 wherein said first pair consisting of the gore flap and the flaps of the stocking material is located above the second pair and said second pair is folded downward before said stocking materials are aligned in a substantially straight line, and said second pair is folded upward after said lower pair is released.

5. A method of seaming panty-hose having gores of a diamond shape according to claim 1, wherein said diamond shaped gore is folded along a diagonal line of the diamond shape and is inserted into said clearance formed between said cut flaps.

6. A method of seaming panty-hose having gores of a diamond shape, which method comprises following steps of a through f in sequence:

step a in which, after a pair of stocking materials formed in a cylindrical shape is held by means of template assemblies so as to align the sides of said stocking materials with each other, the overlapped central portions of said stocking materials are cut to form cut edges with cut flaps at said edges and then front portions of the cut flaps are opened with the front portions of the cut flaps exposed outwardly;

step b in which the cut edges of said stocking materials are spread out until said cut edges are aligned in a reverse V-shape condition while said cut edges are held and the cut flaps of said stocking materials are folded outside and spaced from each other to provide a space therebetween;

step c in which, after a folded gore which has a diamond shape is inserted into a clearance formed between said separated cut flaps, the lower flap of the gore is folded downwards and held with the cut flaps of the lower stocking materials, and then, said template assemblies which hold said stocking materials and said gore are aligned with a circular passage;

step d in which the upper gore flap and the cut flaps of the upper stocking materials, which cut flaps are overlapped with said upper gore flap, are seamed by means of a sewing machine;

step e in which the seamed portion is folded upward and is held, and then, said lower flap of said gore which has been held is released and is transferred to a seaming station where another sewing machine is located; and step f in which the remaining lower flap of said gore and the remaining cut flaps of said stocking materials are seamed together.

7. A method of seaming panty-hose according to claim 6, wherein the overlapped gore flap and the cut flaps of said stocking material, which flaps are positioned upward, are seamed along a first seam line which extends from a first position located at an end portion of said gore to a second position located at the other end of said gore by means of said first sewing machine, then the overlapped gore flap and the cut flaps of the other stocking material, which flaps are positioned downward, are seamed along a second seam line which extends from a cut flap end of said stocking material to the other cut flap end of said stocking material via said gore flap by means of said second sewing machine.

8. A method of seaming panty-hose having gores of a diamond shape according to claim 7, which further includes the step in which the spread flaps are tensioned for maintaining said flaps in a substantially straight line condition during the seaming operation, said tensioning being caused by application of a suction to said spread flaps.

9. A method of seaming panty-hose having gores of a diamond shape, said method comprising the steps of holding a pair of stocking materials formed in a cylindrical shape to align the sides of the stocking materials with each other;

cutting overlapped central portions of the stocking materials from one end to a thigh portion of each stocking material to form cut edges with cut flaps;

spreading the cut edges of the stocking materials until the cut edges are aligned in a reverse V-shape condition while the cut edges are held and the cut flaps of the stocking materials are vertically separated from each other;

inserting a folded gore of diamond shape into a clearance formed between the separated cut flaps, holding the folded gore with the stocking materials, folding a first gore flap and the flap of one of the stocking materials outward, and aligning the held gore edges and the held edges of the stocking materials in a substantially straight line condition;

seaming a second gore flap and a cut flap of the other stocking material on a first sewing machine while holding the gore and stocking materials;

folding the seamed second gore flap and flap of the other stocking material outward, and seaming the first gore flap and the flap of the first stocking material on a second sewing machine while the gore and stocking materials are held.

10. A method as set forth in claim 1 wherein the diamond shaped gore is folded along a diagonal line of the diamond shape.

11. A method of seaming panty-hose having gores of a diamond shape, said method comprising the steps of:

holding a pair of stocking materials formed in a cylindrical shape to align the sides of the stocking materials with each other, cutting overlapped centered portion of the aligned materials from one end to a thigh portion to form cut edges with cut flaps, opening and folding front portions of said cut flaps of the stocking materials outwardly;

spreading the cut edges of the stocking materials out until the cut edges are aligned in a reverse V-shape condition while holding the cut edges and vertically separating the cut flaps from each other;

inserting a folded gore of a diamond shape into a clearance formed between the separated cut flaps, folding the lower flap of the gore downward and holding the lower flap with the cut flap of the lower stocking materials, and then aligning the stocking materials and the gore with a circular passage;

seaming the upper gore flap and the cut flap of the upper stocking material on a sewing machine;

folding the seamed flaps upwardly; and thereafter seaming the lower flap of the gore and the remaining cut flap of the stocking materials.

* * * * *

UNITED STATES PATENT AND TRADEMARK OFFICE

CERTIFICATE OF CORRECTION

PATENT NO. : 4,188,897
DATED : February 19, 1980
INVENTOR(S) : Osho Takatori

It is certified that error appears in the above-identified patent and that said Letters Patent are hereby corrected as shown below:

Col. 1, line 48, after "addition" insert a -- , --.

Col. 1, line 55, change "case" to --cases--.

Col. 2, line 21, change "core" to --gore--.

Col. 2, line 27, change "core" to --gore--.

Col. 2, line 27, change "flaps" to --flap--.

Col. 4, line 26, change "in" to --In--.

Col. 4, line 41, after "slicing" insert -- , --.

Col. 6, line 48, change "208" to --209--.

Col. 6, line 66, change "208" to --209--.

Col. 7, line 16, change "rails" to --rail--.

Col. 8, line 41, correct spelling of "thereof".

Col. 12, line 27, change "plate" to --plates--.

UNITED STATES PATENT AND TRADEMARK OFFICE

CERTIFICATE OF CORRECTION

PATENT NO. : 4,188,897

DATED : February 19, 1980

INVENTOR(S) : Osho Takatori

It is certified that error appears in the above—identified patent and that said Letters Patent is hereby corrected as shown below:

Col. 13, line 51, change "Fig" to --Figs--

Col. 14, line 63, after "see" delete --(--

Col. 17, line 32, change "are" first occurrence to --and--.

Col. 20, line 46, change "flaps" to --flap--.

Signed and Sealed this

*Seventh* Day of *July 1981*

[SEAL]

*Attest:*

RENE D. TEGTMEYER

*Attesting Officer* *Acting Commissioner of Patents and Trademarks*